United States Patent [19]

Sakashita et al.

[11] Patent Number: 4,985,327

[45] Date of Patent: Jan. 15, 1991

[54] NON-MAGNETIC TONER

[75] Inventors: Kiichiro Sakashita, Inagi; Hirohide Tanikawa, Yokohama; Satoshi Yoshida, Kawasaki; Toshiaki Nakahara, Tokyo; Naoki Matsushige, Kawasaki; Masatsugu Fujiwara; Yasuo Mitsuhashi, both of Yokohama, all of Japan

[73] Assignee: Canon Kabushiki Kaisha, Tokyo, Japan

[21] Appl. No.: 526,680

[22] Filed: May 22, 1990

[30] Foreign Application Priority Data

Feb. 24, 1988 [JP] Japan ..... 63-41453
Feb. 25, 1988 [JP] Japan ..... 63-43116

[51] Int. Cl.[5] ..... G03G 9/08; G03G 9/10; G03G 9/14

[52] U.S. Cl. ..... 430/106.6; 430/110; 430/111; 430/903

[58] Field of Search ..... 430/106.6, 110, 111, 430/903

[56] References Cited

U.S. PATENT DOCUMENTS 3,674,736 7/1922 Lerman et al. ..... 430/111 X
3,969,251 7/1976 Jones et al. ..... 430/111 X
4,284,701 8/1981 Abbott et al. ..... 430/111
4,299,900 11/1981 Mitsuhashi et al. ..... 430/122
4,543,312 9/1985 Murakawa et al. ..... 430/106.6 X
4,592,987 6/1986 Mitsuhashi et al. ..... 430/102
4,737,433 4/1988 Rimai et al. ..... 430/111

FOREIGN PATENT DOCUMENTS 0291296 11/1988 European Pat. Off. .
2114310 1/1983 United Kingdom .
2180948 4/1987 United Kingdom .

*Primary Examiner*—Roland Martin
*Attorney, Agent, or Firm*—Fitzpatrick, Cella, Harper & Scinto

[57] ABSTRACT

A developer for developing electrostatic images, comprising a non-magnetic toner, the toner containing 17–60% by number of non-magnetic toner particles of 5 microns or smaller, containing 1–30% by number of non-magnetic toner particles of 8–12.7 microns, and containing 2.0% by volume or less of nonmagnetic toner particles of 16 microns or larger; wherein the non-magnetic toner has a volume-average particle size of 4–10 microns, and the non-magnetic toner particles of 5 microns or smaller have a particle size distribution satisfying the following formula:

$$N/V = -0.04N + k,$$

wherein N denotes % by number of non-magnetic toner particles of 5 microns of smaller, V denotes % by volume of non-magnetic toner particles of 5 microns or smaller k denotes a positive number of 4.5–6.5, and N denotes a positive number of 17–60.

35 Claims, 6 Drawing Sheets

NON-MAGNETIC TONER

This application is a continuation of application Ser. No. 313,518 filed Feb. 22, 1989, now abandoned.

FIELD OF THE INVENTION AND RELATED ART

The present invention relates to a non-magnetic toner for a one-component or two-component developer used for developing an electrostatic latent image in image forming methods such as electrophotography and electrostatic recording.

Recently, as image forming apparatus such as electrophotographic copying machines have widely been used, their uses have also extended in various ways, and higher image quality has been demanded. For example, when original images such as general documents and books are copied, it is demanded that even minute letters are reproduced extremely finely and faithfully without thickening or deformation, or interruption. However, in ordinary image forming apparatus such as copying machines for plain paper, when the latent image formed on a photosensitive member thereof comprises thin-line images having a width of 100 microns or below, the reproducibility in thin lines is generally poor and the clarity of line images is still insufficient.

Particularly, in recent image forming apparatus such as electrophotographic printers using digital image signals, the resultant latent picture is formed by a gathering of dots with a constant potential, and the solid, half-tone and highlight portions of the picture can be expressed by varying densities of dots. However, in a state where the dots are not faithfully covered with toner particles and the toner particles protrude from the dots, there arises a problem that a gradational characteristic of a toner image corresponding to the dot density ratio of the black portion to the white portion in the digital latent image cannot be obtained. Further, when the resolution is intended to be enhanced by decreasing the dot size so as to enhance the image quality, the reproducibility becomes poorer with respect to the latent image comprising minute dots, whereby there tends to occur an image without sharpness having a low resolution and a poor gradational characteristic.

On the other hand, in image forming apparatus such as electrophotographic copying machines, there sometimes occurs a phenomenon such that good image quality is obtained in an initial stage but it deteriorates as the copying or print-out operation is successively conducted. The reason for such phenomenon may be considered that only toner particles which contribute to the developing operation are consumed in advance as the copying or print-out operation is successively conducted, and toner particles having a poor developing characteristic accumulate and remain in the developing device of the image forming apparatus.

Hitherto, there have been proposed some developers for the purpose of enhancing the image quality. For example, Japanese Laid-Open Patent Application (JP-A, KOKAI) No. 3244/1976 (corresponding to U.S. Pat. Nos. 3942979, 3969251 and 4112024) has proposed a non-magnetic toner wherein the particle size distribution is regulated so as to improve the image quality. This toner comprises relatively coarse particles and particularly preferably comprises about 60% by number or more of toner particles having a particle size of 8–12 microns. However, according to our investigation, it is difficult for such particle size to provide uniform and dense cover-up of the toner particles to a latent image. Further, the above-mentioned toner has a characteristic such that it contains 30% by number or less (e.g., about 29% by number) of particles of 5 microns or smaller and 5% by number or less (e.g., about 5% by number) of particles of 20 microns or larger, and therefore it has a broad particle size distribution which tends to decrease the uniformity in the resultant image. In order to form a clear image by using such relatively coarse toner particles having a broad particle size distribution, it is necessary that the gaps between the toner particles are filled by thickly superposing the toner particles thereby to enhance the apparent image density. As a result, there arises a problem that the toner consumption necessarily increases in order to obtain a prescribed image density.

Japanese Laid-Open Patent Application No. 72054/1979 (corresponding to U.S. Pat. No. 4284701) has proposed a non-magnetic toner having a sharper particle size distribution than the above-mentioned toner. In this toner, particles having an intermediate weight have a relatively large particle size of 8.5–11.0 microns, and there is still room for improvement as a toner for a high resolution.

Japanese Laid-Open Patent Application No. 129437/1983 (corresponding to British Patent No. 2114310) has proposed a non-magnetic toner wherein the average particle size is 6–10 microns and the mode particle size is 5–8 microns. However, this toner only contains particles of 5 microns or less in a small amount of 15% by number or below, and it tends to form an image without sharpness.

SUMMARY OF THE INVENTION

An object of the present invention is to provide a non-magnetic toner which has solved the above-mentioned problems.

Another object of the present invention is to provide a non-magnetic toner for a two-component developer which has an excellent thin-line reproducibility and gradational characteristic and is capable of providing a high image density.

A further object of the present invention is to provide a non-magnetic toner for a two-component developer which shows little change in performances when used for a long period.

A further object of the present invention is to provide a non-magnetic toner for a two-component developer which shows little change in performances even when environmental conditions change.

A further object of the present invention is to provide a non-magnetic toner for a two-component developer which shows an excellent transferability.

A further object of the present invention is to provide a non-magnetic toner for a two-component developer which is capable of providing a high image density by using a small consumption thereof.

A still further object of the present invention is to provide a non-magnetic toner for a two-component developer which is capable of forming a toner image excellent in resolution, gradational characteristic, and thin-line reproducibility even when used in an image forming apparatus using a digital image signal.

A further object of the present invention is to provide a non-magnetic toner for a one-component developer which has an excellent thin-line reproducibility and gradational characteristic and is capable of providing a high image density.

A further object of the present invention is to provide a non-magnetic toner for a one-component developer which shows little change in performances when used in a long period.

A further object of the present invention is to provide a non-magnetic toner for a one-component developer which shows little change in performances even when environmental conditions change.

A further object of the present invention is to provide a non-magnetic toner for a one-component developer which shows an excellent transferability.

A further object of the present invention is to provide a non-magnetic toner for a one-component developer which is capable of providing a high image density by using a small consumption thereof.

A still further object of the present invention is to provide a non-magnetic toner for a one-component developer which is capable of forming a toner image excellent in resolution, gradational characteristic, and thin-line reproducibility even when used in an image forming apparatus using a digital image signal.

According to our investigation, it has been found that toner particles having a particle size of 5 microns or smaller have a primary function of clearly reproducing the contour of a latent image and of attaining close and precise cover-up of the toner to the entire latent image portion. Particularly, in the case of an electrostatic latent image formed on a photosensitive member, the field intensity in the edge portion thereof as the contour is higher than that in the inner portion thereof because of the concentration of the electric lines of force, whereby the sharpness of the resultant image is determined by the quality of toner particles collected to this portion. According to our investigation, it has been found that the control of quantity and distribution state for toner particles of 5 microns or smaller is effective in solving the problem in image sharpness.

The developer for developing electrostatic images according to the present invention is based on the above knowledge and comprises: a non-magnetic toner, the toner containing 17–60% by number of non-magnetic toner particles having a particle size of 5 microns or smaller, containing 1–30% by number of non-magnetic toner particles having a particle size of 8–12.7 microns, and containing 2.0% by volume or less of non-magnetic toner particles having a particle size of 16 microns or larger; wherein the non-magnetic toner has a volume-average particle size of 4–10 microns, and the non-magnetic toner particles having a particle size of 5 microns or smaller have a particle size distribution satisfying the following formula:

$$N/V = -0.04N + k,$$

wherein N denotes the percentage by number of non-magnetic toner particles having a particle size of 5 micron or smaller, V denotes the percentage by volume of non-magnetic toner particles having a particle size of 5 microns or smaller, k denotes a positive number of 4.5–6.5, and N denotes a positive number of 17–60.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
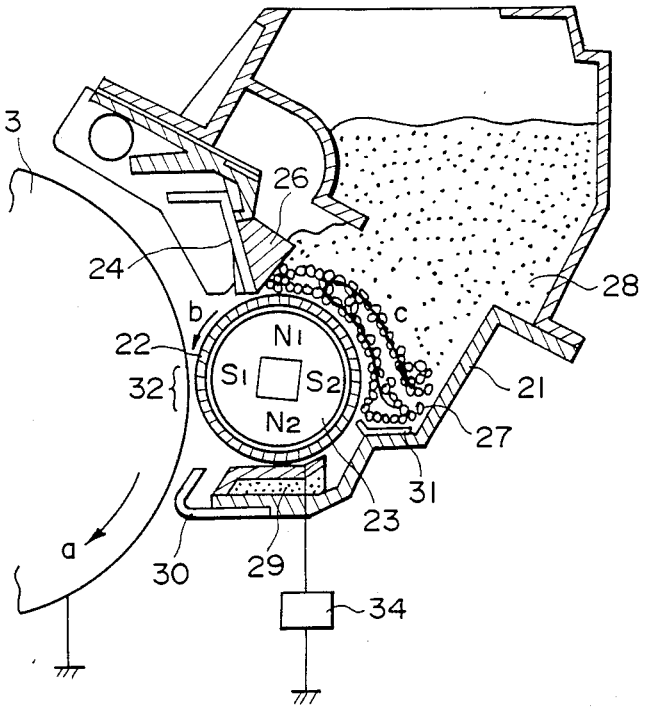
FIGS. 1 and 6 are schematic sectional views each of which show a developing device used for image formation in the Examples and Comparative Examples.

The non-magnetic toner according to the present invention having specific particle size distribution as described above can faithfully reproduce thin lines in a latent image formed on a photosensitive member, and is excellent in reproduction of dot latent images such as halftone dot and digital images, whereby it provides images excellent in gradation and resolution characteristics. Further, the toner according to the present invention can retain a high image quality even in the case of successive copying or print-out, and can effect good development by using a smaller consumption thereof as compared with the conventional non-magnetic toner, even in the case of high-density images. As a result, the non-magnetic toner of the present invention is excellent in economical characteristics and further has an advantage in miniaturization of the main body of a copying machine or printer.

The term "non-magnetic toner" used in the present invention refers to a toner showing a saturation magnetization of 0–10 emu/g under an external magnetic field of 5,000 oersted (Öe).

The reason for the above-mentioned effects of the non-magnetic toner of the present invention is not necessarily clear but may assumably be considered as follows.

The non-magnetic toner of the present invention is first characterized in that it contains 17–60% by number of non-magnetic toner particles of 5 microns or below. Conventionally, it has been considered that non-magnetic toner particles of 5 microns or below are required to be positively reduced because the control of their charge amount is difficult, they impair the fluidity of the non-magnetic toner, and they cause toner scattering to contaminate a machine, and cause fog in the resultant image.

However, according to our investigation, it has been found that the non-magnetic toner particles of 5 microns or below are an essential component to form a high-quality image.

For example, we have conducted the following experiment.

Thus, there was formed on a photosensitive member a latent image wherein the surface potential on the photosensitive member was changed from a large developing potential contrast at which the latent image would easily be developed with a large number of toner particles, to a half-tone developing potential contrast, and further to a small developing potential contrast at which the latent image would be developed with only a small number of toner particles.

Such latent image was developed with a one-component developer comprising a non-magnetic toner or a two-component developer comprising carrier particles and the non-magnetic toner having a particle size distribution ranging from 0.5 to 30 microns. Then, the toner particles attached to the photosensitive member were collected and the particle size distribution thereof was measured. As a result, it was found that there were many non-magnetic toner particles having a particle size of 8 microns or below, particularly 5 microns or below. Based on such finding, it was discovered that when non-magnetic toner particles of 5 microns or below were so controlled that they were smoothly supplied for the development of a latent image formed on a photosensitive member, there could be obtained an image truly excellent in reproducibility, and the toner particles were faithfully attached to the latent image without protruding therefrom.

The non-magnetic toner of the present invention is secondly characterized in that it contains 1–30% by number (preferably 1–23% by number) of non-magnetic toner particles of 8–12.7 microns. Such second feature relates to the above-mentioned necessity for the presence of the toner particles of 5 microns or below.

As described above, the toner particles having a particle size of 5 microns or below have the ability to strictly cover a latent image and to faithfully reproduce it. On the other hand, in the latent image per se, the field intensity in its peripheral edge portion is higher than that in its central portion. Therefore, toner particles sometimes cover the inner portion of the latent image in a smaller amount than that in the edge portion thereof, whereby the image density in the inner portion appears to be lower. Particularly, the non-magnetic toner particles of 5 microns or below strongly have such tendency. However, we have found that when 1–30% by number (preferably 1–23% by number) of toner particles of 8–12.7 microns are contained in a toner, not only the above-mentioned problem can be solved but also the resultant image can be made clearer.

According to our knowledge, the reason for such phenomenon may be considered that the toner particles of 8–12.7 microns have a charge amount suitably controlled in relation to those of 5 microns or below, and that these toner particles are supplied to the inner portion of the latent image having a lower field intensity than that of the edge portion thereby to compensate the decrease in cover-up of the toner particles to the inner portion as compared with that in the edge portion, and to form a uniform developed image. As a result, there may be provided a sharp image having a high-image density and excellent resolution and gradation characteristic.

The third feature of the non-magnetic toner of the present invention is that toner particles having a particle size of 5 microns or smaller contained therein satisfy the following relation between their percentage by number (N) and percentage by volume (V):

$$N/V = -0.04N + k.$$

wherein $4.5 \leqq k \leqq 6.5$, and $17 \leqq N \leqq 60$.

Figure 5:
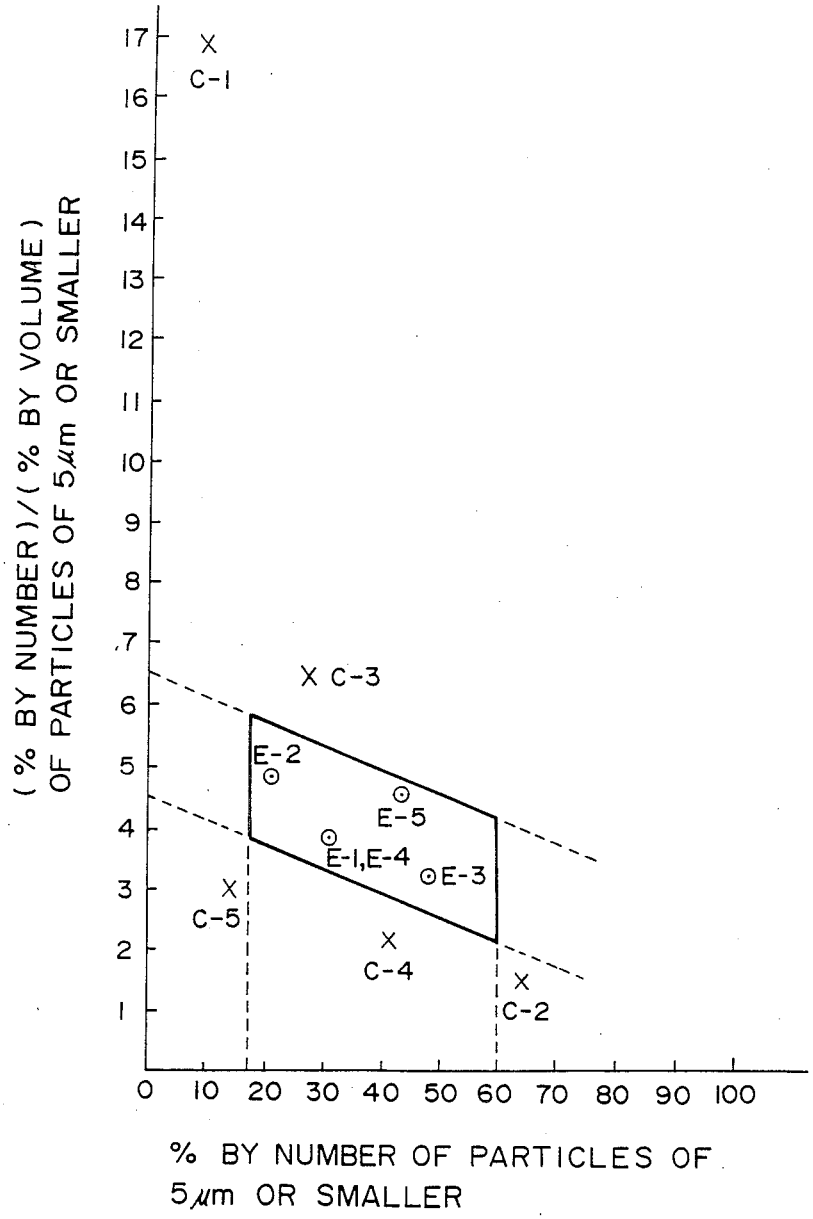
FIGS. 5 and 7 are graphs obtained by plotting values of % by number (N)/% by volume (V) against % by number with respect to non-magnetic toner particles having a particle size of 5 microns or below.
Figure 7:
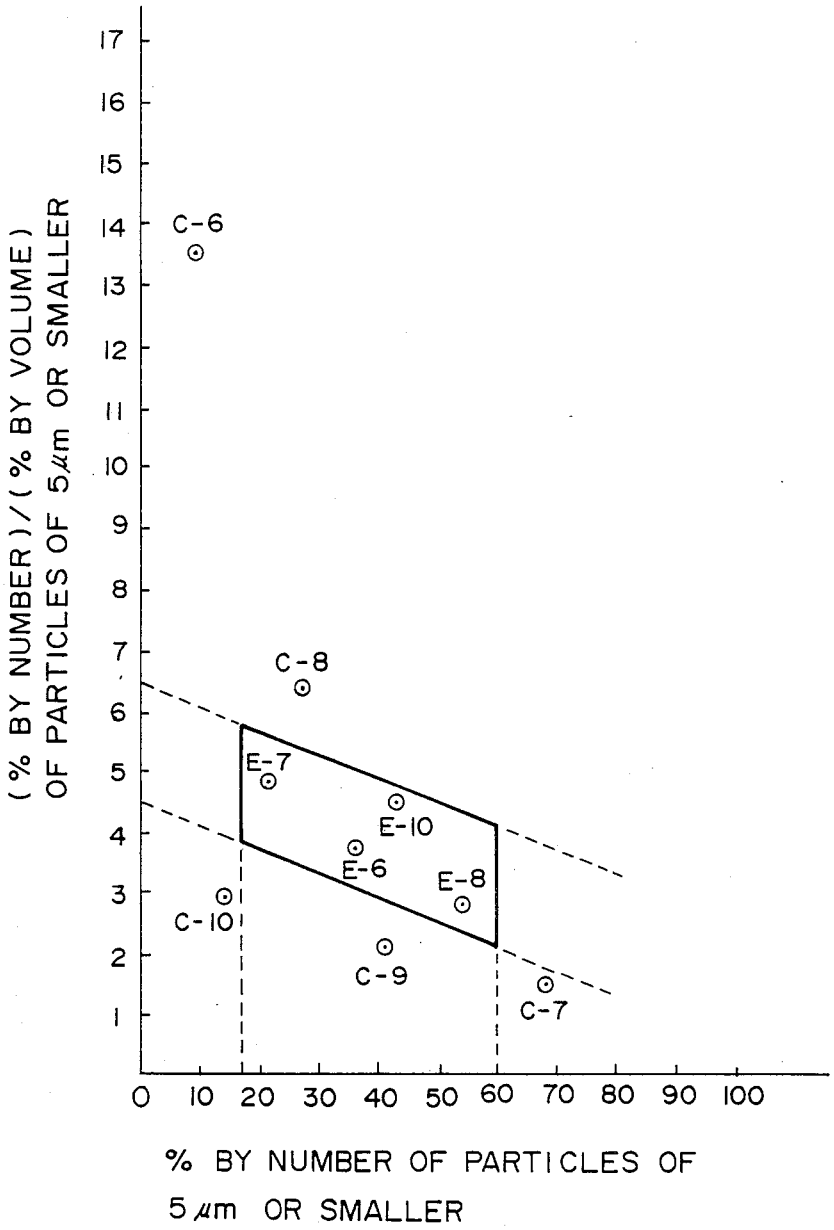

The region satisfying such relationship is shown in FIG. 5 or 7. The non-magnetic toner according to the present invention which has the particle size distribution satisfying such region, in addition to the above-mentioned features, can attain excellent developing characteristic.

According to our investigation on the state of the particle size distribution with respect to toner particles of 5 microns or below, we have found that there is a suitable state of the presence of fine powder in non-magnetic toner particles. More specifically, in the case of a certain value of N, it may be understood that a large value of N/V indicates that the particles of 5 microns or below (e.g., 2–4 microns) are significantly contained, and a small value of N/V indicates that the frequency of the presence of particles near 5 microns (e.g., 4–5 microns) is high and that of particles having a smaller particle size is low. When the value of N/V is in the range of 2.1–5.82, N is in the range of 17–60, and the relation represented by the above-mentioned formula is satisfied, good thin-line reproducibility and high resolution are attained.

In the non-magnetic toner of the present invention, non-magnetic toner particles having a particle size of 16 microns or larger are contained in an amount of 2.0% by volume or below. The amount of these particles may preferably be as small as possible.

As described hereinabove, the non-magnetic toner of the present invention has solved the problems encountered in the prior art from a viewpoint utterly different from that in the prior art, and can meet the recent severe demand for high image quality.

Hereinbelow, the present invention will be described in more detail.

In the present invention, the non-magnetic toner particles having a particle size of 5 microns or smaller are contained in an amount of 17–60% by number, preferably 25–50% by number, more preferably 30–50% by number, based on the total number of particles. If the amount of non-magnetic toner particles is smaller than 17% by number, the toner particles effective in enhancing image quality is insufficient. Particularly, as the toner particles are consumed in successive copying or print-out, the component of effective non-magnetic toner particles is decreased, and the balance in the particle size distribution of the non-magnetic toner shown by the present invention is deteriorated, whereby the image quality gradually decreases. On the other hand if, the above-mentioned amount exceeds 60% by number, the non-magnetic toner particles are liable to be mutually agglomerated to produce toner agglomerates having a size larger than the original particle size. As a result, roughened images are provided, the resolution is lowered, and the density difference between the edge and inner portions is increased, whereby an image having an inner portion with a low density is liable to occur.

In the non-magnetic toner of the present invention, the amount of particles in the range of 8–12.7 microns is 1–30% by number, preferably 1–23% by number, more preferably 8–20% by number. If the above-mentioned amount is larger than 30% by number, not only the image quality deteriorates but also excess development (i.e., excess cover-up of toner particles) occurs, thereby to invite an increase in toner consumption. On the other hand if, the above-mentioned amount is smaller than 1% by number, it is difficult to obtain a high image density.

In the present invention, the percentage by number (N %) and that by volume (V %) of non-magnetic toner particles having a particle size of 5 microns or below satisfy a relationship of $N/V = -0.04\ N + k$, wherein k represents a positive number satisfying $4.5 \leqq k \leqq 6.5$. The number k may preferably satisfy $4.5 \leqq k \leqq 6.0$, more preferably $4.5 \leqq k \leqq 5.5$. Further, as described above, the percentage N satisfies $17 \leqq N \leqq 60$, preferably $25 \leqq N \leqq 50$, more preferably $30 \leqq N \leqq 50$.

If $k < 4.5$, non-magnetic toner particles of 5.0 microns or below are insufficient, and the resultant image density, resolution and sharpness decrease. When fine toner particles in a non-magnetic toner, which have conventionally been considered useless, are present in an appropriate amount, they attain closest packing of toner in development (i.e., in a latent image formed on a photosensitive drum) and contribute to the formation of a uniform image free of coarsening. Particularly, these particles fill thinline portions and contour portions of an image, thereby to visually improve the sharpness thereof. If $k < 4.5$ in the above formula, such component becomes insufficient in particle size distribution, whereby the above-mentioned characteristics become poor.

Further, in view of the production process, a large amount of fine powder must be removed by classification in order to satisfy the condition of $k < 4.5$. Such process is disadvantageous in yield and toner costs.

On the other hand, if $k > 6.5$, an excess of fine powder is present, whereby the resultant image density is liable to decrease in successive copying. The reason for such phenomenon may be considered that an excess of fine non-magnetic toner particles having an excess amount of charge are triboelectrically attached to a developing sleeve and prevent normal toner particles from being carried on the developing sleeve or carrier and being supplied with charge.

In the magnetic toner of the present invention, the amount of non-magnetic toner particles having a particle size of 16 microns or larger may preferably be smaller than 2.0% by volume, more preferably 1.0% by volume or smaller, particularly preferably 0.5% by volume or smaller.

If the above amount is larger than 2.0% by volume, these particles impair thin-line reproducibility. In addition, toner particles of 16 microns or larger are present as protrusions on the surface of the thin layer of toner particles formed on a photosensitive member by development, and they vary the transfer condition for the toner by irregulating the delicate contact state between the photosensitive member and a transfer paper (or a transfer-receiving material) by the medium of the toner layer. As a result, there occurs an image with transfer failure.

In the present invention, the volume-average particle size of the toner is 4–10 microns, preferably 4–9 microns, more preferably 4–8 microns. This value closely relates to the above-mentioned features of the non-magnetic toner according to the present invention. If the volume-average particle size is smaller than 4 microns, there tend to occur problems such that the amount of toner particles transferred to a transfer paper is insufficient and the image density is low, in the case of an image such as a graphic image wherein the ratio of the image portion area to the whole area is high. The reason for such phenomenon may be considered the same as in the above-mentioned case wherein the inner portion of a latent image provides a lower image density than that in the edge portion thereof. If the volume-average particle size exceeds 10 microns, the resultant resolution is not good and there tends to occur a phenomenon such that the image quality is lowered in successive use even when it is good in the initial stage thereof.

Although the particle size distribution of a toner is measured by means of a Coulter counter in the present invention, it may also be measured in various ways.

Coulter counter Model TA-II (available from Coulter Electronics Inc.) is used as an instrument for measurement, to which an interface (available from Nikkaki K.K.) for providing a number-basis distribution and a volume-basis distribution, and a personal computer CX-1 (available from Canon K.K.) are connected.

For measurement, a 1%-NaCl aqueous solution as an electrolytic solution is prepared by using a reagent-grade sodium chloride. Into 100 to 150 ml of the electrolytic solution, 0.1 to 5 ml of a surfactant, preferably an alkylbenzenesulfonic acid salt, is added as a dispersant, and 2 to 20 mg of a sample is added thereto. The resultant dispersion of the sample in the electrolytic liquid is subjected to a dispersion treatment for about 1–3 minutes by means of an ultrasonic disperser, and then subjected to measurement of particle size distribution in the range of 2–40 microns by using the above-mentioned Coulter counter Model TA-II with a 100 micron-aperture to obtain a volume-basis distribution and a number-basis distribution. From the results of the volume-basis distribution and number-basis distribution, parameters characterizing the non-magnetic toner of the present invention may be obtained.

The binder for use in constituting the toner according to the present invention, when applied to a hot pressure roller fixing apparatus using an oil applicator, may be a known binder resin for toners. Examples thereof may include: homopolymers of styrene and its derivatives, such as polystyrene, poly-p-chlorostyrene, and polyvinyltoluene; styrene copolymers, such as styrene-p-chlorostyrene copolymer, styrene-vinyltoluene copolymer, styrene-vinylnaphthalene copolymer, styrene-acrylate copolymer, styrene-methacrylate copolymer, styrene-methyl α-chloromethacrylate copolymer, styrene-acrylonitrile copolymer, styrene-vinyl methyl ether copolymer, styrene-vinyl ethyl ether copolymer, styrene-vinyl methyl ketone copolymer, styrene-butadiene copolymer, styrene-isoprene copolymer, and styrene-acrylonitrile-indene copolymer; polyvinyl chloride, phenolic resin, natural resin-modified phenolic resin, natural resin-modified maleic acid resin, acrylic resin, methacrylic resin, polyvinyl acetate, silicone resin, polyester resin, polyurethane, polyamide resin, furan resin, epoxy resin, xylene resin, polyvinylbutyral, terpene resin, coumarone-indene resin and petroleum resin.

In a hot pressure roller fixing system using substantially no oil application, serious problems are occur because of an offset phenomenon, where that a part of toner image on a toner image-supporting member is transferred to a roller, and the intimate adhesion of a toner on the toner image-supporting member. As a toner fixable with less heat energy is generally liable to cause blocking or caking in storage or in a developing apparatus, this should be also taken into consideration. Accordingly, when a hot roller fixing system using almost no oil application is adopted in the present invention, selection of a binder resin becomes more important. A preferred binder resin may for example be a crosslinked styrene copolymer, or a crosslinked polyester. Examples of comonomers to form such a styrene copolymer may include one or more vinyl monomers selected from: monocarboxylic acid having a double bond and their substituted derivatives, such as acrylic acid, methyl acrylate, ethyl acrylate, butyl acrylate, dodecyl acrylate, octyl acrylate, 2-ethylhexyl acrylate, phenyl acrylate, methacrylic acid, methyl methacrylate, ethyl methacrylate, butyl methacrylate, octyl methacrylate, acrylonitrile, methacrylonitrile, and acrylamide; dicarboxylic acids having a double bond and their substituted derivatives, such as maleic acid, butyl maleate, methyl maleate, and dimethyl maleate; vinyl esters, such as vinyl chloride, vinyl acetate, and vinyl benzoate; ethylenic olefins, such as ethylene, propylene, and butylene; vinyl ketones, such as vinyl methyl ketone, and vinyl hexyl ketone; vinyl ethers, such as vinyl methyl ether, vinyl ethyl ether, and vinyl isobutyl ether. As the crosslinking agent, a compound having two or more polymerizable double bonds may principally be used. Examples thereof include: aromatic divinyl compounds, such as divinylbenzene, and divinylnaphthalene; carboxylic acid esters having two double bonds, such as ethylene glycol diacrylate, ethylene glycol dimethacrylate, and 1,3-butanediol diacrylate; divinyl compounds such as divinyl aniline divinyl ether, divinyl sulfide and divinyl sulfone; and compounds having three or more vinyl groups. These compounds may be used singly or in mixture. In view of the fixability and anti-offset characteristic of the toner, the crosslinking agent may preferably be used in an amount of 0.01–10 wt. %, preferably 0.05–5 wt. %, based on the weight of the binder resin.

For a pressure-fixing system, a known binder resin for a pressure-fixable toner may be used. Examples thereof may include: polyethylene, polypropylene, polymethylene, polyurethane elastomer, ethylene-ethyl acrylate copolymer, ethylene-vinyl acetate copolymer, ionomer resin, styrene-butadiene copolymer, styrene-isoprene copolymer, linear saturated polyesters and paraffins.

The non-magnetic toner according to the present invention may also preferably be used as a toner for full- or multi-color image formation.

The color image formation process may for example be carried out by causing light rays from an original to be incident on a photoconductive layer of a photosensitive member through a color-separation transmission filter in a complementary color with a toner color to form an electrostatic latent image on the photoconductive layer. Then, the toner of the color is held on a support (material) such as plain paper through the developing and transfer steps. The above steps are repeated for toners of other colors several times in register with and superposition on the previous toner image on the same support, and the superposed toner images are subjected to a single fixing step to provide a final full-color image.

For such purpose, color toners of yellow, magenta and cyan (additionally, a black toner as desired) may generally be used.

When the non-magnetic toner according to the present invention is used as the toner for color image formation, there may be obtained a good color image excellent in color mixing characteristic and gloss characteristic. In such case, in view of the color mixing characteristic, the binder resin may preferably be a non-crosslinked polyester resin which shows a low viscosity at a fixing temperature.

In the non-magnetic toner of the present invention, it is preferred that a charge controller may be incorporated in the toner particles (internal addition), or may be mixed with the toner particles (external addition). By using the charge controller, it is possible to most suitably control the charge amount corresponding to a developing system to be used. Particularly, in the present invention, it is possible to further stabilize the balance between the particle size distribution and the charge. As a result, when the charge controller is used in the present invention, it is possible to further clarify the above-mentioned functional separation and mutual compensation corresponding to the respective particle size ranges, in order to enhance the image quality.

Examples of a positive charge controller may include; nigrosine and its modification products modified by a fatty acid metal salt; quaternary ammonium salts, such as tributylbenzyl-ammonium-1-hydroxy-4-naphthosulfonic acid salt, and tetrabutylammonium tetrafluoroborate; diorganotin oxides, such as dibutyltin oxide, dioctyltin oxide, and dicyclohexyltin oxide; and diorganotin borates, such as dibutyltin borate, dioctyltin borate, and dicyclohexyltin borate. These positive charge controllers may be used singly or as a mixture of two or more species. Among these, a nigrosine-type charge controller or a quaternary ammonium salt charge controller may particularly preferably be used.

As another type of positive charge controller, there may be used a homopolymer of a monomer having an amino group represented by the formula:

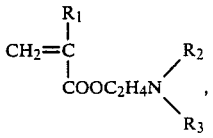

wherein $R_1$ represents H or $CH_3$; and $R_2$ and $R_3$ each represent a substituted or unsubstituted alkyl group (preferably $C_1$–$C_4$); or a copolymer of the monomer having an amine group with another polymerizable monomer such as styrene, acrylates, and methacrylates as described above. In this case, the positive charge controller also has a function of (a part or the entirety of) a binder.

On the other hand, a negative charge controller can be used in the present invention. Examples thereof may include an organic metal complex or a chelate compound. More specifically there may preferably be used aluminum acetyl-acetonate, iron (II) acetylacetonate, and a 3,5-di-tertiary butylsalicylic acid chromium. There may more preferably be used acetylacetone complexes (inclusive of monoalkyl- or dialkyl-substituted derivatives thereof), or salicylic acid-type metal salts or complexes (inclusive of monoalkyl- or dialkyl-substituted derivatives thereof). Among these, salicylic acid-type complexes or metal salts may particularly preferably be used.

It is preferred that the above-mentioned charge controller (one not having a function of a binder) is used in the form of fine powder. In such case, the number-average particle size thereof may preferably be 4 microns or smaller, more preferably 3 microns or smaller.

In the case of internal addition, such charge controller may preferably be used in an amount of 0.1–20 wt. parts, more preferably 0.2–10 wt. parts, per 100 wt. parts of a binder resin.

It is preferred that silica fine powder is added to the non-magnetic toner of the present invention.

In the non-magnetic toner of the present invention having the above-mentioned particle size distribution characteristic, the specific surface area thereof becomes larger than that in the conventioned toner. In a case where the non-magnetic toner particles are caused to contact the surface of a cylindrical electroconductive sleeve containing a magnetic field-generating means therein in order to triboelectrically charge them, the frequency of the contact between the toner particle surface and the sleeve is increased as compared with that in the conventional non-magnetic toner, whereby the abrasion of the toner particle and/or the contamination of the sleeve is liable to occur. However, when the non-magnetic toner of the present invention is combined with the silica fine powder, the silica fine powder is disposed between the toner particles and the carrier or sleeve surface, whereby the abrasion of the toner particle is remarkably reduced.

Thus, the life of the non-magnetic toner and/or the sleeve may be lengthened and the chargeability may stably be retained. As a result, there can be provided a one-component developer, or a two-component developer comprising a non-magnetic toner and carrier, which shows excellent characteristics in long-time use. Further, the non-magnetic toner particles having a particle size of 5 microns or smaller, which play an important role in the present invention, may produce a better effect in the presence of the silica fine powder, thereby to stably provide high-quality images.

The silica fine powder may be that produced through the dry process and the wet process. The silica fine powder produced through the dry process is preferred in view of the anti-filming characteristic and durability thereof.

The dry process referred to herein is a process for producing silica fine powder through vapor-phase oxidation of a silicon halide.

On the other hand, in order to produce silica powder to be used in the present invention through the wet process, various processes known heretofore may be applied.

The silica powder to be used herein may be anhydrous silicon dioxide (colloidal silica), and also a silicate such as aluminum silicate, sodium silicate, potassium silicate, magnesium silicate and zinc silicate.

Among the above-mentioned silica powders, those having a specific surface area as measured by the BET method with nitrogen adsorption of 30 $m^2/g$ or more, particularly 50–400 $m^2/g$, provides a good result.

In the present invention, the silica fine powder may preferably be used in an amount of 0.01–8 wt. parts, more preferably 0.1–5 wt. parts, with respect to 100 wt. parts of the non-magnetic toner.

In the case where the non-magnetic toner of the present invention is used as a positively chargeable non-magnetic toner, it is preferred to use positively chargeable fine silica powder rather than negatively chargeable fine silica powder, in order to prevent the abrasion of the toner particle and the contamination on the carrier or sleeve surface, and to retain the stability in chargeability.

In order to obtain positively chargeable silica fine powder, the above-mentioned silica powder obtained through the dry or wet process may be treated with a silicone oil having an organic groups containing at least one nitrogen atom in its side chain, a nitrogen-containing silane coupling agent, or both of these.

In the present invention, "positively chargeable silica" means one having a positive triboelectric charge with respect to an iron powder carrier when measured by the blow-off method.

The silicone oil having a nitrogen atom in its side chain to be used in the treatment of silica fine powder may be a silicone oil having at least the following partial structure:

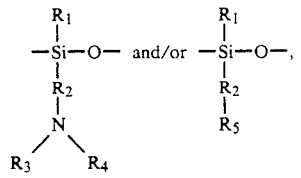

wherein $R_1$ denotes hydrogen, alkyl, aryl or alkoxyl; $R_2$ denotes alkylene or phenylene; $R_3$ and $R_4$ respectively denote hydrogen, alkyl, or aryl; and $R_5$ denotes a nitrogen-containing heterocyclic group.

The above alkyl, aryl, alkylene and phenylene group can contain an organic group having a nitrogen atom, or have a substituent such as halogen within an extent not impairing the chargeability. The above-mentioned silicone oil may preferably be used in an amount of 1–50 wt. %, more preferably 5–30 wt. %, based on the weight of the silica fine powder.

The nitrogen-containing silane coupling agent used in the present invention generally has a structure represented by the following formula:

$$R_m\text{—Si-}Y_n,$$

wherein R is an alkoxy group or a halogen atom; Y is an amino group or an organic group having at least one amino group or nitrogen atom; and m and n are positive integers of 1–3 satisfying the relationship of $m+n=4$.

The organic group having at least one nitrogen group may for example be an amino group having an organic group as a substituent, a nitrogen-containing heterocyclic group, or a group having a nitrogen-containing heterocyclic group. The nitrogen-containing heterocyclic group may be unsaturated or saturated and may respectively be known ones. Examples of the unsaturated heterocyclic ring structure providing the nitrogen-containing heterocyclic group may include the following:

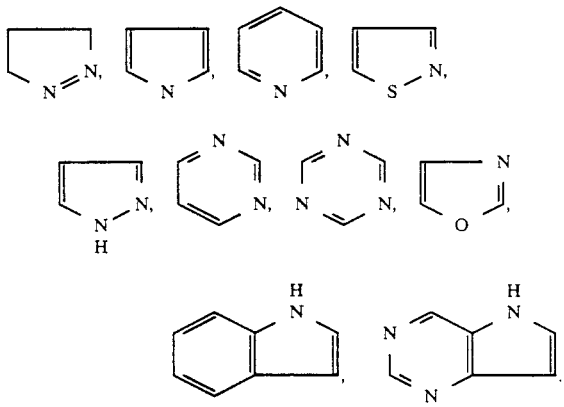

Examples of the saturated heterocyclic ring structure include the following:

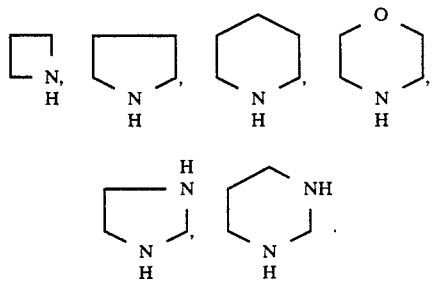

The heterocyclic groups used in the present invention may preferably be those of five-membered or six-membered rings in consideration of stability.

Examples of the silane coupling agent include:
aminopropyltrimethoxysilane,
aminopropyltriethoxysilane,
dimethylaminopropyltrimethoxysilane,
diethylaminopropyltrimethoxysilane,
dipropylaminopropyltrimethoxysilane,
dibutylaminopropyltrimethoxysilane,
monobutylaminopropyltrimethoxysilane,
dioctylaminopropyltrimethoxysilane,
dibutylaminopropyldimethoxysilane,
dibutylaminopropylmonomethoxysilane,
dimethylaminophenyltriethoxysilane,
trimethoxysilyl-γ-propylphenylamine, and
trimethoxysilyl-γ-propylbenzylamine.
Further, examples of the nitrogen-containing heterocyclic compounds represented by the above structural formulas include:
trimethoxysilyl-γ-propylpiperidine,
trimethoxysilyl-γ-propylmorpholine, and
trimethoxysilyl-γ-propylimidazole.

The above-mentioned nitrogen-containing silane coupling agent may preferably be used in an amount of 1–50 wt. %, more preferably 5–30 wt. %, based on the weight of the silica fine powder.

The thus treated positively chargeable silica powder shows an effect when added in an amount of 0.01–8 wt. parts, and more preferably may be used in an amount of 0.1–5 wt. parts, respectively with respect to the positively chargeable non-magnetic toner to show a positive chargeability with excellent stability. As a preferred mode of addition, the treated silica powder in an amount of 0.1–3 wt. parts with respect to 100 wt. parts of the positively chargeable non-magnetic toner should preferably be in the form of being attached to the surface of the toner particles. The above-mentioned untreated silica fine powder may be used in the same amount as mentioned above.

The silica fine powder used in the present invention may be treated as desired with another silane coupling agent or with an organic silicon compound for the purpose of enhancing hydrophobicity. The silica powder may be treated with such agents in a known manner so that they react with or are physically adsorbed by the silica powder. Examples of such treating agents include hexamethyldisilazane, trimethylsilane, trimethylchlorosilane, trimethylethoxysilane, dimethyldichlorosilane, ethyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, triorganosilylmercaptans such as trimethylsilylmercaptan, triorganosilyl acrylates, vinyldimethylacetoxysilane, dimethylethoxysilane, dimethyldimethoxysilane, diphenyldiethoxysilane, hexamethyldisiloxane, 1,3-divinyltetramethyldisiloxane, 1,3-diphenyltetramethyldisiloxane, and dimethylpolysiloxane having 2 to 12 siloxane units per molecule and each containing one hydroxyl group bonded to Si at the terminal units. These may be used alone or as a mixture of two or more compounds.

The above-mentioned treating agent may preferably be used in an amount of 1–40 wt. % based on the weight of the silica fine powder. However, the above treating agent may be used so that the final product of the treated silica fine powder shows positive chargeability.

In the present invention, titanium oxide ($TiO_2$) powder preferably having a BET specific surface area of 50–400 $m^2/g$ may be used instead of the silica fine powder. Further, a powder mixture of the silica fine powder and the titanium oxide fine powder may also be used.

In the present invention, it is preferred to add fine powder of a fluorine-containing polymer such as polytetrafluoroethylene, polyvinylidene fluoride, or tetrafluoroethylene-vinylidene fluoride copolymer. Among these, polyvinylidene fluoride fine powder is particularly preferred in view of fluidity and abrasiveness. Such powder of a fluorine-containing polymer may preferably be added to the toner in an amount of 0.01–2.0 wt. %, more preferably 0.02–1.5 wt. %, particularly 0.02–1.0 wt. %.

In the non-magnetic toner wherein the silica fine powder and the above-mentioned fluorine-containing fine powder are combined, while the reason is not necessarily clear, there occurs a phenemenon such that the state of the presence of the silica attached to the toner particle is stabilized and, for example, the attached silica is prevented from separating from the toner particle so that the effect thereof on toner abrasion and carrier or sleeve contamination are prevented from decreasing, and the stability in chargeability can further be enhanced.

As the colorant usable in the present invention as desired, a known dye and/or pigment may be used. Example thereof may include: carbon black, Phthalocyanine Blue, Peacock Blue, Permanent Red, Lake Red, Rhodamine Lake, Hansa Yellow, Permanent Yellow, Benzidine Yellow, etc.

The colorant content may preferably be 0.1–20 wt. parts, more preferably 0.5–20 wt. parts, per 100 wt. parts of a binder resin. Further, in order to improve the transparency of an OHP (overhead projector) film to which a toner image has been fixed, the colorant content may preferably be 12 parts or smaller, more preferably 0.5–9 wt. parts, per 100 wt. parts of a binder resin.

Another optional additive may be mixed in the non-magnetic toner of the present invention as desired. Such optional additives to be used include, for example, lubricants such as zinc stearate; abrasives such as cerium oxide and silicon carbide; flowability improvers such as colloidal silica and aluminum oxide; anti-caking agents; or conductivity-imparting agents such as carbon black and tin oxide. For example, when 0.1–5 wt. % of a conductivity-imparting agent such as carbon black and titanium oxide is added to the toner, excess charging thereof on a sleeve is suppressed, whereby a stable charging state is retained. When spherical fine resin powder having an average particle size of 0.05–3 microns, preferably 0.1–1 micron is added to the toner a, similar effect can be obtained and the sharpness of an image may be enhanced. The addition amount thereof may preferably be 0.01–10 wt. %, more preferably 0.05–5 wt. %, particularly 0.05–2 wt. %, based on the weight of the toner. Such spherical fine resin powder may preferably comprise a vinyl-type polymer or copolymer, more preferably an alkyl methacrylate-type polymer or copolymer. The above-mentioned spherical fine resin powder may preferably have a charging polarity reverse to, or a weak charging polarity the same as, that of the non-magnetic toner.

In order to improve releasability in hot-roller fixing, it is also a preferred embodiment of the present invention to add to the non-magnetic toner a waxy material such as low-molecular weight polyethylene, low-molecular weight polypropylene, microcrystalline wax, carnauba wax, sasol wax or paraffin wax, preferably in an amount of 0.5–5 wt. %.

The carrier usable in the present invention may include: magnetic material powder such as iron powder, ferrite powder or products obtained by treating these powders with a resin; glass beads, or non-magnetic metal oxide particles, or products obtained by treating these particle with a resin.

The carrier may preferably be used in an amount of 10–1000 wt.parts, more preferably 30–500 wt.parts, per 10 wt.parts of the non-magnetic toner. In view of the matching with the non-magnetic toner according to the present invention having a relatively small particle size, the carrier may preferably have a volume-average particle size of 4–100 microns, more preferably 10–50 microns.

The non-magnetic toner for developing electrostatic images according to the present invention may be produced by sufficiently mixing a vinyl or non-vinyl thermoplastic resin such as those enumerated hereinbefore, and an optional additive such as a pigment or dye as colorant, a charge controller, another additive, etc., by means of a mixer such as a ball mill, etc.; then melting and kneading the mixture by hot kneading means such as hot rollers, kneader and extruder to disperse or dissolve the pigment or dye in the melted resin; cooling and crushing the mixture; and subjecting the powder product to precise classification to form the non-magnetic toner according to the present invention.

The non-magnetic toner of the present invention may be used for a two-component type image forming method in combination with magnetic particles (carrier).

Such a two-component developer may particularly and preferably be used in an image forming method wherein a magnetic particle regulation means is disposed opposite to a toner-carrying member; a magnetic brush is formed on the surface of toner-carrying member upstream of the magnetic particle regulation means with respect to the moving direction of the toner-carrying member, on the basis of magnetic force due to a magnetic field generation means such as a magnet; a thin layer of a non-magnetic toner is formed on the toner-carrying member while regulating the magnetic brush by the magnetic particle regulation member; and an alternating electric field is applied between the toner-carrying member and a latent image-bearing member to attach the non-magnetic toner to the latent image-bearing member thereby to effect development.

Such developing method is specifically explained with reference to FIGS. 1 and 2.

The developing apparatus shown in FIG. 1 comprises a latent image-bearing member 3 such as a photosensitive drum, a developer container 21, a non-magnetic sleeve 22 as a toner-carrying member, a fixed magnet 23, a magnetic or non-magnetic blade 24, a member 26 for limiting a circulation region for magnetic particles, a container portion 29 for collecting a developer, a member 30 for preventing scattering, a magnetic member 31, and a bias power supply 34. In FIG. 1, a reference numeral 27 denotes magnetic particles (carrier), numeral 28 denotes a non-magnetic toner, and numeral 32 denotes a developing zone.

The sleeve 22 is rotated in the arrow b direction and the magnetic particles 27 circulate in the arrow c direction along with such rotation. Based on such movement, the contact and/or rubbing between the sleeve surface and the magnetic particle layer occurs, whereby a layer of the non-magnetic particles is formed on the sleeve surface. While the magnetic particles circulate in the arrow c direction, a part thereof is regulated to a predetermined amount by the gap or clearance between the magnetic or non-magnetic blade 24 and the sleeve 22, and applied onto the non-magnetic developer layer. In this arrangement, the non-magnetic toner (inclusive of a non-magnetic toner to which an external additive such as hydrophobic silica has been added) is applied onto both of the sleeve surface and the magnetic particle surfaces, whereby there is obtained an effect equivalent to that obtained by increasing the surface are of the sleeve 22.

In the developing zone 32, one magnetic pole of the fixed magnet 23 is disposed opposite to the latent image-bearing surface to form a clear magnetic pole ($S_1$) for development, and the toner particles are caused to fly from the sleeve surface and magnetic particle surfaces to the latent image-bearing surface, under the action of the alternating electric field, thereby to effect development.

Next, such developing phenomenon is explained in more detail with reference to FIG. 2.

Figure 2:
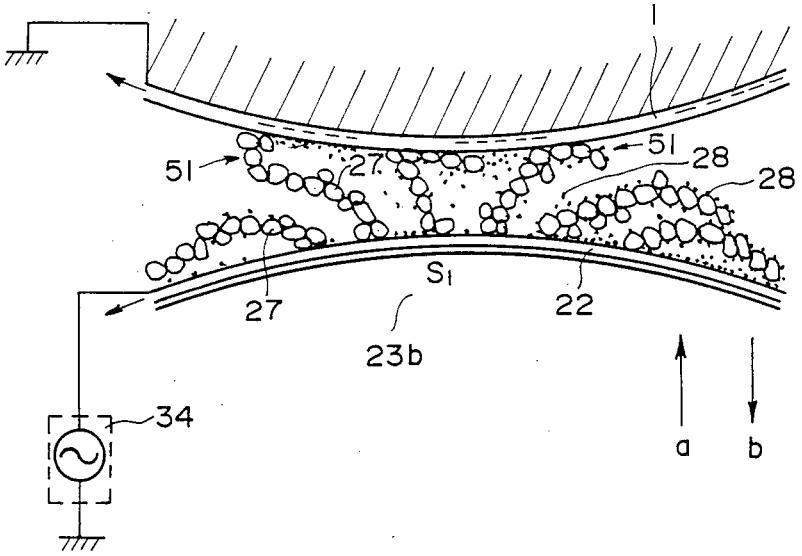
FIG. 2 is an enlarged partial schematic view of the developing position (or developing zone) of the above-mentioned developing apparatus.

In the embodiment as shown in FIG. 2, an electrostatic latent image (a dark portion) formed on a photosensitive drum 1 comprises negative charges, the direction of the electric field based on the electrostatic latent image is represented by an arrow d. The direction of the electric field based on the alternating voltage changes alternately. In the phase wherein a positive component is applied to the sleeve 22 side, the direction of the electric field based on the alternating voltage corresponds to that based on the latent image. At this time, the amount of charges injected to an ear 51 by the electric field becomes maximum, and accordingly the ear 51 assumes a maximum erection state as shown in FIG. 2, whereby the long ear 51 is lengthened to the surface of the photosensitive drum 1.

On the other hand, the toner particles 28 disposed on the sleeve 22 and the magnetic particle 27 are, e.g., positively charged, and they are transferred to the photosensitive drum 1 under the action of the electric field formed in the space. At this time, the ears 51 are erected in a coarse state and the surface of the sleeve 22 is exposed, whereby the toner 28 is released from both of the surface of the sleeve 22 and the surface of the ear 51. In addition, charges having the same polarity as that of the toner 28 are present in the ear 51, the toner 28 disposed on the ear 51 becomes more movable due to the electric repulsion.

In the phase wherein a negative component is applied to the sleeve 22 side, the direction of the electric field (arrow e) based on the alternating voltage is reverse to that (arrow d) based on the latent image, as shown in FIG. 2. Accordingly, the electric field in this space is strengthened in the reverse direction and the amount of charges injected to the ear 51 becomes relatively small, whereby the ears 51 assume a contact state wherein they are shortened corresponding to the amount of the injected charges.

On the other hand, because the toner particles 28 disposed on the photosensitive drum 1 are positively charged as mentioned above, they are reversely transferred to the surface of the sleeve 22 or the surfaces of the magnetic particles 27 under the action of the electric field formed in the space.

Thus, the toner particles 28 are reciprocated between the photosensitive drum 1 and the sleeve 22 surface or the magnetic particle 27 surfaces. As the space between the photosensitive drum 1 and the sleeve 22 becomes larger due to rotation, the electric field becomes weaker, thereby to complete development.

In the ear 51, there are present charges including triboelectric charges due to rubbing with the toner 28, or charges injected by mirror image force, or the action of the alternating electric field applied between the electrostatic latent image formed on the photosensitive drum 1 and the sleeve 22. The condition of such charges changes depending on the charge-discharge time constant which is determined by the material constituting the magnetic particles 27, etc.

As described above, the ear 51 of the magnetic particles 27 assumes a minute and intense vibration state.

After the developing operation, the magnetic particles 27 and toner particles 28 not used for the development are recovered to the developer container along with the rotation of the sleeve 22.

The sleeve 22 can be a cylinder of paper or synthetic resin. When the sleeve is constituted by imparting electroconductivity to the surface of such cylinder or by using a conductive material such as aluminum, brass and stainless steel, it may be used as an electrode roller for development.

The non-magnetic toner according to the present invention, when used as one-component developer, may preferably be applied to an image forming method wherein a latent image is developed while toner particles are caused to fly from a toner-carrying member such as a cylindrical sleeve to a latent image-carrying member such as a photosensitive member.

In such case, the non-magnetic toner is supplied with triboelectric charge mainly due to the contact thereof with the sleeve surface and applied onto the sleeve surface in a thin layer form. The thin layer of the non-magnetic toner is formed so that the thickness thereof is smaller than the clearance between the photosensitive member and the sleeve in a developing zone. In the development of a latent image formed on the photosensitive member, it is preferred to cause the non-magnetic toner particles having triboelectric charge to fly from the sleeve to the photosensitive member, while applying an alternating electric field between the photosensitive member and the sleeve.

Examples of the alternating electric field may include a pulse electric field, or an electric field based on an AC bias or a superposition of AC and DC biases.

Figure 6:
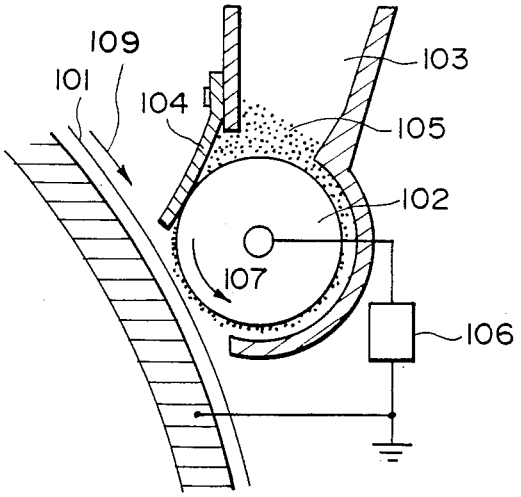

FIG. 6 shows an embodiment of the method and apparatus using a developer comprising the one-component type non-magnetic toner according to the present invention.

Referring to FIG. 6, an electrostatic latent image is formed on a cylindrical electrostatic image-bearing member 101 by a known electrophotographic process such as the Carlson process or NP process. On the other hand, an insulating non-magnetic toner 105 contained in a hopper 103 as a toner supply means is applied onto a toner-carrying member 102, while regulating the thickness of the toner layer by an application means 104. The above-mentioned latent image is developed with the thus applied toner.

The toner-carrying member 102 may be a developing roller comprising a stainless steel cylinder. The material for the developing roller can also be aluminum or another metal. In addition, the developing roller can be a metal roller coated with a resin in order to triboelectrically charge the toner a to more desirable polarity, or can comprise an electroconductive non-metal material.

Figure 8:
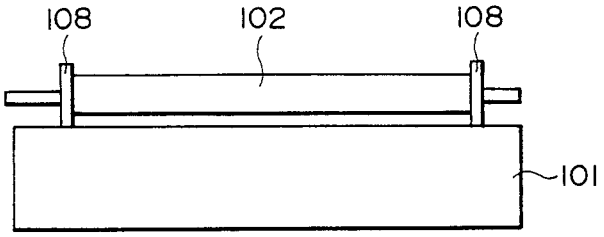
FIG. 8 is a partial schematic plan view showing a relative arrangement of a photosensitive member, a developer-carrying member and a spacer roller.

At the both ends of the cylindrical toner-carrying member 102 as shown in FIG. 8, two disk-shaped spacer rollers 108 of, e.g., high density polyethylene are respectively disposed so that the axes thereof correspond to the rotation axis of the toner-carrying member 102. When the developing apparatus is assembled so that the spacer rollers are caused to contact the both ends of the electrostatic image-bearing member 101, the clearance between the electrostatic image-bearing member 101 and the toner-carrying member 102 may be retained so that it is larger than the thickness of the toner layer to be applied onto the toner-carrying member 102.

The above-mentioned clearance may preferably be 100–500 microns, more preferably 150–300 microns. If the clearance is too large, the electrostatic force due to the latent image formed on the electrostatic image-bearing member 101 which affects the non-magnetic toner applied onto the toner-carrying member 102 becomes weaker, the image quality deteriorates, and particularly, it is difficult to visualize a thin line image by development. On the other hand if, the clearance is too small, there can be enhanced a risk such that the toner applied on the toner-carrying member 102 is compressed between the toner-carrying member 102 and the electrostatic image-bearing member 101 becomes agglomerated.

Incidentaally, the spacer roller 108 may preferably have a disk-like shape having a diameter larger than that of the sleeve 102, and a thickness of about 5 mm–1 cm. Two spacer rollers are generally disposed at the both ends of the cylindrical sleeve 102, so that the center thereof corresponds to the rotation axis of the sleeve 102 and they contact the photosensitive drum 101. The spacer roller may be disposed so as to be rotatable or not.

In FIG. 6, reference numeral 106 denotes a power supply for developing bias for applying a voltage between the toner-carrying member 102 and the electrostatic image-bearing member 101. The developing bias voltage used herein may preferably one as disclosed in Japanese Patent Publication (Kokoku) No. 32375/1983.

Incidentally, in the present invention, the thin-line reproducibility may be measured in the following manner.

An original image comprising thin lines accurately having a width of 100 microns is copied under a suitable copying condition, i.e., a condition such that a circular original image having a diameter of 5 mm and an image density of 0.3 (halftone) is copied to provide a copy image having an image density of 0.3–0.5, thereby to obtain a copy image as a sample for measurement. An enlarged monitor image of the sample is formed by means of a particle analyzer (Luzex 450, mfd. by Nihon Regulator Co. Ltd.) as a measurement device, and the line width is measured by means of an indicator. Because the thin line image comprising toner particles has unevenness in the width direction, the measurement points for the line width are determined so that they correspond to the average line width, i.e., the average of the maximum and minimum line widths. Based on such measurement, the value (%) of the thin-line reproducibility is calculated according to the following formula:

$$\frac{\text{Line width of copy image obtained by the measurement}}{\text{Line width of the original (100 microns)}} \times 100$$

Further, in the present invention, the resolution may be measured in the following manner.

There are formed ten species of original images comprising a pattern of five thin lines which have equal line width and are disposed at equal intervals equal to the line width. In these ten species of original images, thin lines are respectively drawn so that they provide densities of 2.8, 3.2, 3.6, 4.0, 4.5, 5.0, 5.6, 6.3, 7.1, and 8.0 lines per 1 mm. These ten species of original images are copied under the above-mentioned suitable copying conditions to form copy images which are then observed by means of a magnifying glass. The value of the resolution is so determined that it corresponds to the maximum number of thin lines (lines/mm) of an image wherein all the thin lines are clearly separated from each other. As the above-mentioned number is larger, it indicates a higher resolution.

Hereinbelow, the present invention will be described in further detail with reference to Examples. In the following formulations, "parts" are parts by weight.

EXAMPLE 1

| | |
|---|---|
| Styrene/butyl acrylate/divinyl benzene copolymer (copolymerization wt. ratio: 80/19.5/0.5, weight-average molecular weight: 320,000) | 100 wt. parts |
| Nigrosin (number-average particle size: about 3 microns) | 4 wt. parts |
| Low-molecular weight propylene-ethylene copolymer | 4 wt. parts |
| Carbon black | 5 wt. parts |

The above ingredients were well blended in a blender and melt-kneaded at 150° C. by means of a two-axis extruder. The kneaded product was cooled, coarsely crushed by a cutter mill, finely pulverized by means of a pulverizer using jet air stream, and classified by a fixed-wall type wind-force classifier (DS-type Wind-Force Classifier, mfd. by Nippon Pneumatic Mfd. Co. Ltd.) to obtain a classified powder product. Ultra-fine powder and coarse power were simultaneously and precisely removed from the classified powder by means of a multi-division classifier utilizing a Coanda effect (Elbow Jet Classifier available from Nittetsu Kogyo K.K.), thereby to obtain black fine powder (non-magnetic toner) having a number-average particle size of 7.7 microns. The thus obtained non-magnetic toner showed a saturation magnetization of 0 emu/g with respect to an external magnetic field of 5000 oersted.

The number-basis distribution and volume-basis distribution of the thus obtained non-magnetic toner of positively chargeable black fine powder were measured by means of a Coulter counter Model TA-II with a 100 micron-aperture in the above-described manner. The thus obtained results are shown in the following Table 1.

TABLE 1

| | | % by number (N) | | % by volume (V) | |
|---|---|---|---|---|---|
| Size (μm) | Number of particles | Distribution | Accumulation | Distribution | Accumulation |
| 2.00–2.52 | 1581 | 1.5 | 1.5 | 0.0 | 0.0 |
| 2.52–3.17 | 4125 | 3.8 | 5.3 | 0.0 | 0.0 |
| 3.17–4.00 | 9117 | 8.4 | 13.6 | 1.5 | 1.5 |
| 4.00–5.04 | 18908 | 17.4 | 31.0 | 6.7 | 8.2 |
| 5.04–6.35 | 25970 | 23.9 | 54.9 | 16.9 | 25.1 |
| 6.35–8.00 | 28560 | 26.3 | 81.2 | 33.3 | 58.4 |
| 8.00–10.08 | 17300 | 15.9 | 97.1 | 31.5 | 89.9 |
| 10.08–12.70 | 3000 | 2.8 | 99.9 | 9.6 | 99.5 |
| 12.70–16.00 | 101 | 0.1 | 100.0 | 0.5 | 100.0 |
| 16.00–20.20 | 0 | 0.0 | 100.0 | 0.0 | 100.0 |
| 20.20–25.40 | 0 | 0.0 | 100.0 | 0.0 | 100.0 |
| 25.40–32.00 | 0 | 0.0 | 100.0 | 0.0 | 100.0 |
| 32.00–40.30 | 0 | 0.0 | 100.0 | 0.0 | 100.0 |
| 40.30–50.80 | 0 | 0.0 | 100.0 | 0.0 | 100.0 |

Figure 3:
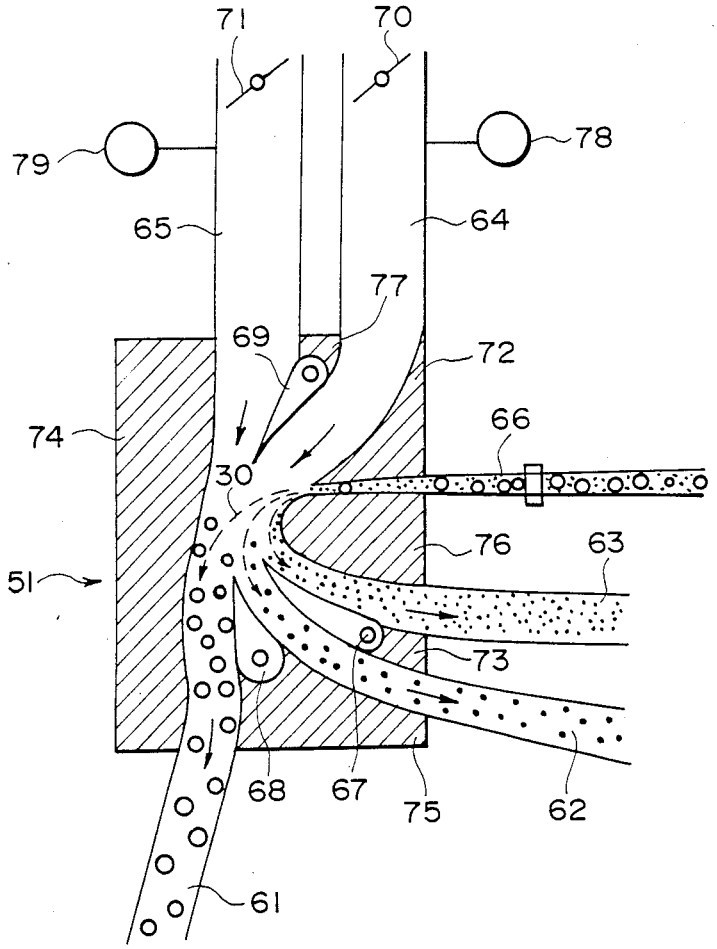
FIGS. 3 and 4 are a front sectional view and a sectional perspective view, respectively, of an apparatus embodiment for practicing multi-division classification.
Figure 4:
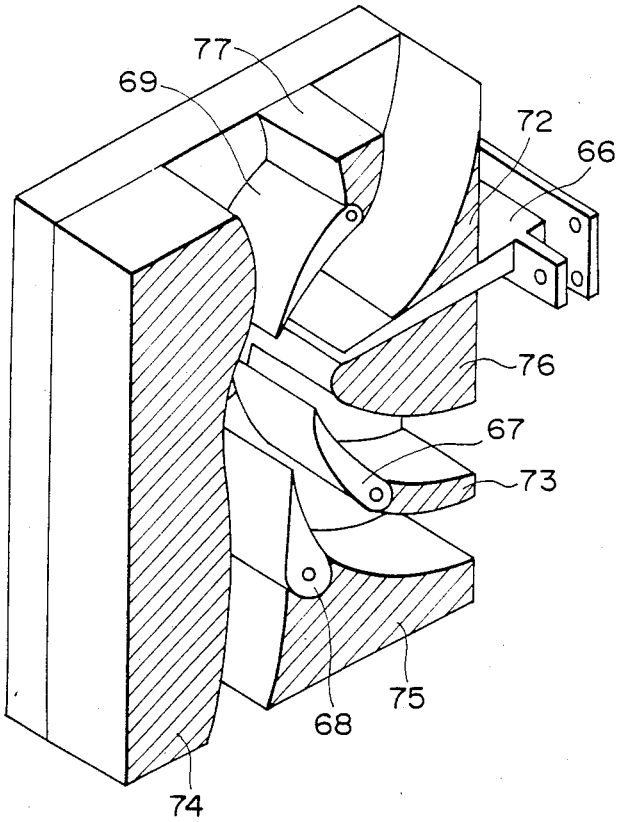

FIG. 3 schematically shows the classification step using the multi-division classifier, and FIG. 4 shows a sectional perspective view of the multi-division classifier.

0.5 wt. parts of positively chargeable hydrophobic dry process silica (BET specific surface area: 200 $m^2/g$) were added to 100 wt. parts of the non-magnetic toner of black fine powder obtained above and mixed therewith by means of a Henschel mixer. Further, 10 parts of the resultant non-magnetic toner (external addition product) were mixed with 90 parts of ferrite carrier (volume-average particle size of 40 microns) thereby to obtain a positively chargeable two-component developer comprising a non-magnetic toner.

The above-mentioned non-magnetic toner showed a particle size distribution and various characteristics as shown in Table 3 appearing hereinafter.

The thus prepared one-component developer was charged in an image forming (developing) device as shown in FIG. 1, and a developing test was conducted.

The developing conditions used in this instance is explained with reference to FIG. 1.

Referring to FIG. 1, a photosensitive drum 3 was rotated in the arrow a direction at a peripheral speed of 100 mm/sec. A stainless steel sleeve 22 comprised 20 mm-dia. cylinder (thickness: 0.8 mm) of which surface had been subjected to blasting treatment by using spherical glass beads, and was rotated in the arrow b direction at a peripheral speed of 150 mm/sec.

On the other hand, a fixed magnet 23 of a ferrite sinter-type was disposed in the rotating sleeve 22 so that the magnetic poles thereof were disposed as shown in FIG. 2 and it provided a maximum magnetic flux density of about 980 gauss at the surface of the sleeve. A non-magnetic blade 24 comprised a 1.2 mm-thick stainless steel blade, and the clearance between the blade and the sleeve was set to 400 microns.

Opposite to the sleeve 22, a laminate-type organic photoconductor (OPC) drum 3 was disposed. On the surface of the drum 3 an electrostatic latent image comprising a charge pattern comprising a dark part of −600 V and a light part of −150 V was formed. The clearance between the drum 3 and the sleeve 22 surface was set to 350 microns.

By using the above-mentioned apparatus, normal development was conducted by applying a voltage having a frequency of 1800 Hz, a peak-to-peak voltage of 1300 V and a central value of −200 V, to the sleeve 22 by means of a power supply 34. Thereafter, the resultant toner image was transferred to plain paper by using a negative corona transfer means and then fixed thereto by a hot pressure roller fixing means. Such image formation tests were successively conducted 10,000 times thereby to provide 10,000 sheets of toner images. The thus obtained results are shown in Table 4 appearing hereinafter.

As apparent from Table 4, both the line portion and large image area portion of the letters showed a high image density. The non-magnetic toner of the present invention was excellent in thin-line reproducibility and resolution, and retained good image quality was obtained in the initial stage even after 10,000 sheets of image formations. Further, the copying cost per one sheet was low, whereby the non-magnetic toner of the present invention was excellent in economical characteristics.

Hereinbelow, the multi-division classifier and the classification step used in this instance are explained with reference to FIGS. 3 and 4.

Referring to FIGS. 3 and 4, the multidivision classifier has side walls 72, 73 and 74, and a lower wall 75. The side wall 73 and the lower wall 75 are provided with knife edge-shaped classifying wedges 67 and 68, respectively, whereby the classifying chamber is divided into three sections. At a lower portion of the side wall 72, a feed supply nozzle 66 opening into the classifying chamber is provided. A Coanda block 76 is disposed along the lower tangential line of the nozzle 66 so as to form a long elliptic arc shaped by bending the tangential line downwardly. The classifying chamber has an upper wall 77 provided with a knife edge-shaped gas-intake wedge 69 extending downwardly. Above the classifying chamber, gas-intake pipes 64 and 65 opening into the classifying chamber are provided. In the intake pipes 64 and 65, a first gas introduction control means 70 and a second gas introduction control means 71, respectively, comprising, e.g., a damper, are provided; and also static pressure gauges 78 and 79 are disposed communicatively with the pipes 64 and 65, respectively. At the bottom of the classifying chamber, exhaust pipes 61, 62 and 63 having outlets are disposed corresponding to the respective classifying sections and opening into the chamber.

Feed powder to be classified is introduced into the classifying zone through the supply nozzle 66 under reduced pressure. The feed powder thus supplied is caused to fall along curved lines 30 due to the Coanda effect given by the Coanda block 76 and the action of the streams of high-speed air, so that the feed powder is classified into coarse powder 61, black fine powder 62 having prescribed volume-average particle size and particle size distribution, and ultra-fine powder 63.

EXAMPLE 2

A non-magnetic toner was prepared in the same manner as in Example 1 except that the micropulverization and classification conditions were controlled to obtain a toner having characteristics as shown in Table 3 appearing hereinafter. The thus obtained toner was evaluated in the same manner as in Example 1.

As a result, as shown in Table 4 appearing hereinafter, clear high-quality images were stably obtained.

EXAMPLE 3

A non-magnetic toner was prepared in the same manner as in Example 1 except that the micropulverization and classification conditions were controlled to obtain a toner having characteristics as shown in Table 3 appearing hereinafter. The thus obtained toner was evaluated in the same manner as in Example 1.

As a result, as shown in Table 4 appearing hereinafter, clear high-quality images were stably obtained.

EXAMPLE 4

0.5 wt. parts of positively chargeable hydrophobic dry process silica and 0.3 wt. parts of polyvinylidene fluoride fine powder (average primary particle size: about 0.3 micron, weight-average molecular weight (Mw): 300,000) were added to 100 wt. parts of the black fine powder (non-magnetic toner) obtained in Example 1, and mixed therewith by means of a Henschel mixer thereby to obtain a non-magnetic toner (external addition product). By using the thus obtained non-magnetic toner, a two-component developer was prepared in the same manner as in Example 1.

The thus obtained developer was evaluated in the same manner as in Example 1. As a result, as shown in Table 4 appearing hereinafter, there were obtained better images excellent in image density and stability in image quality.

EXAMPLE 5

| | |
|---|---|
| Crosslinked polyester resin (Mw = 50,000, glass transition point (Tg) = 60° C.) | 100 wt. parts |
| 3,5-di-t-butylsalicylic acid metal salt | 1 wt. part |
| Low-molecular weight propylene-ethylene copolymer | 3 wt. parts |
| Carbon black | 5 wt. parts |

By using the above materials, black fine powder was prepared in the same manner as in Example 1.

0.3 wt. parts of negatively chargeable hydrophobic silica (BET specific surface area: 130 $m^2/g$) were added to 100 wt. parts of the black fine powder obtained above and mixed therewith by means of a Henschel mixer thereby to obtain a negative chargeable non-magnetic toner (external addition product).

The above-mentioned black fine powder showed a particle size distribution, etc., as shown in Table 3 appearing hereinafter. 10 parts of the non-magnetic toner (external addition product) were mixed with 90 parts of ferrite carrier (volume-average particle size: 35 microns) to obtain a two-component developer.

The thus prepared two-component developer was charged in a copying machine having an amorphous silicon photosensitive drum capable of forming a positive electrostatic latent image (NP-7550, mfd. by Canon K.K.) which had been modified so that it could use a two-component developer, and image formation tests of 10,000 sheets using normal development were conducted.

As a result, as shown in Table 4 appearing hereinafter, clear high-quality images were stably obtained.

COMPARATIVE EXAMPLE 1

Black fine powder (non-magnetic toner) as shown in Table 3 was prepared in the same manner as in Example 1, except that two fixed-wall type wind-force classifiers used in Example 1 were used for the classification instead of the combination of the fixed-wall type wind-force classifier and the multi-division classifier used in Example 1.

In the thus prepared non-magnetic toner of Comparative Example 1, the percentage by number of the non-magnetic toner particles of 5 microns or smaller was smaller than the range thereof defined in the present invention, the volume-average particle size was larger than the range thereof defined in the present invention, and the value of (% by number (N))/(% by volume (V)) of the non-magnetic toner particles of 5 microns or smaller was larger than the range thereof defined in the present invention, whereby the conditions required in the present invention were not satisfied. The particle size distribution of magnetic toner obtained above is shown in the following Table 2.

TABLE 2

| Size (μm) | Number of particles | % by number (N) Distribution | % by number (N) Accumulation | % by volume (V) Distribution | % by volume (V) Accumulation |
|---|---|---|---|---|---|
| 2.00–2.52 | 437 | 1.3 | 1.3 | 0.0 | 0.0 |
| 2.52–3.17 | 507 | 1.5 | 2.8 | 0.0 | 0.0 |
| 3.17–4.00 | 613 | 1.8 | 4.6 | 0.0 | 0.0 |
| 4.00–5.04 | 1308 | 3.8 | 8.4 | 0.5 | 0.5 |
| 5.04–6.35 | 3658 | 10.8 | 19.2 | 2.6 | 3.1 |
| 6.35–8.00 | 6750 | 19.9 | 39.1 | 8.7 | 11.8 |
| 8.00–10.08 | 8628 | 25.4 | 64.5 | 17.6 | 29.4 |
| 10.08–12.70 | 7474 | 22.0 | 86.4 | 29.2 | 58.6 |
| 12.70–16.00 | 3812 | 11.2 | 97.7 | 29.1 | 87.7 |
| 16.00–20.20 | 698 | 2.1 | 99.7 | 9.8 | 97.5 |
| 20.20–25.40 | 82 | 0.2 | 100.0 | 2.1 | 99.6 |
| 25.40–32.00 | 11 | 0.0 | 100.0 | 0.4 | 100.0 |
| 32.00–40.30 | 1 | 0.0 | 100.0 | 0.0 | 100.0 |
| 40.30–50.80 | 1 | 0.0 | 100.0 | 0.0 | 100.0 |

0.5 wt. parts of positively chargeable hydrophobic dry process silica were added to 100 wt. parts of the black fine powder obtained above mixed therewith in the same manner as in Example 1 thereby to obtain a non-magnetic toner (external addition product). 10 parts of the non-magnetic toner (external addition product) was mixed with 90 parts of ferrite carrier (volume-average particle size: 40 microns) to obtain a two-component developer. The thus obtained developer was subjected to image formation tests under the same conditions as in Example 1.

In the resultant images, the toner particles remarkably protruded from the latent image formed on the photosensitive member, the thin-line reproducibility was 145% which was poorer than that in Example 1, and the resolution was 4.0 lines/mm. Further, after 10,000 sheets of image formations, the image density in the solid black pattern decreased and the thin line reproducibility and resolution deteriorated. Moreover, the toner consumption was large.

The results are shown in Table 4 appearing hereinafter.

COMPARATIVE EXAMPLE 2

Evaluation was conducted in the same manner as in Example 1 except that a toner as shown in Table 3 was used instead of the non-magnetic toner used in Example 1.

In the resultant images, thin lines were contaminated in several places presumably due to the aggregates of toner particles, and the resolution was 3.6 lines/mm. The solid black pattern, particularly the inner portion thereof, had a lower image density than that in the line image and the edge portion of the image. Further, fog contamination in spot forms occurred, and the image quality was further deteriorated in successive copying.

COMPARATIVE EXAMPLE 3

Evaluation was conducted in the same manner as in Example 1 except that a toner as shown in Table 3 was used instead of the non-magnetic toner used in Example 1.

The developed image formed on the drum had relatively good image quality, while it was somewhat disturbed. However, the toner image was remarkably disturbed in the transfer step, whereby transfer failure occurred and the image density decreased. Particularly, in successive copying, the image density was further decreased and the image quality was further deteriorated because poor toner particles remained and accumulated in the developing device.

COMPARATIVE EXAMPLE 4

Evaluation was conducted in the same manner as in Example 1 except that a toner as shown in Table 3 was used instead of the non-magnetic toner used in Example 1.

In the resultant images, the image density was low and the contour was unclear and the sharpness was lacking, because the cover-up of toner particles to the edge portions of images was poor. Further, the resolution and gradational characteristic were also poor. When successive copying was conducted, sharpness, thin-line reproducibility and resolution were further deteriorated.

COMPARATIVE EXAMPLE 5

Evaluation was conducted in the same manner as in Example 1 except that a toner as shown in Table 3 was used instead of the non-magnetic toner used in Example 1.

In the resultant images, the image density, resolution and the thin-line reproducibility were all poor. Further, the edge portion of the image lacked in sharpness, and the thin lines were interrupted and unclear.

The results in Examples 1–5 and Comparative Examples 1–5 described above are inclusively shown in the following Tables 3 and 4.

TABLE 3

| | Particle size distribution of toner | | | | |
|---|---|---|---|---|---|
| | % by number of particles ≦5 μm | % by volume of particles ≧16 μm | % by number of particles of 8–12.7 μm | Volume-average particle size (μm) | (% by number)/(% by volume) of particles ≦5 μm |
| Example | | | | | |
| 1 | 31 | 0.0 | 19 | 7.7 | 3.8 |
| 2 | 21 | 0.5 | 20 | 8.6 | 4.8 |
| 3 | 48 | 0.2 | 13 | 6.8 | 3.2 |
| 4 | 31 | 0.0 | 19 | 7.7 | 3.8 |

TABLE 3-continued

| | Particle size distribution of toner | | | | |
|---|---|---|---|---|---|
| | % by number of particles ≦5 μm | % by volume of particles ≧16 μm | % by number of particles of 8–12.7 μm | Volume-average particle size (μm) | (% by number)/(% by volume) of particles ≦5 μm |
| 5 | 43 | 0.5 | 10 | 7.4 | 4.5 |
| Comparative Example | | | | | |
| 1 | 8.4 | 12.3 | 47 | 12.3 | 16.8 |
| 2 | 64 | 0.1 | 5 | 6.2 | 1.4 |
| 3 | 27 | 4 | 15 | 7.6 | 6.4 |
| 4 | 41 | 0.3 | 7 | 6.7 | 2.1 |
| 5 | 14 | 0.2 | 51 | 9.9 | 2.9 |

TABLE 4-1

| | Initial stage | | | |
|---|---|---|---|---|
| | Dmax *1 (5 mm diameter) | Dmax *2 (solid black portion) | Thin-line reproducibility | Resolution (lines/mm) |
| Example | | | | |
| 1 | 1.30 | 1.30 | 104% | 6.3 |
| 2 | 1.31 | 1.29 | 103% | 6.3 |
| 3 | 1.29 | 1.27 | 106% | 6.3 |
| 4 | 1.32 | 1.32 | 104% | 6.3 |
| 5 | 1.33 | 1.32 | 104% | 7.1 |
| Comparative Example | 1.28 | 1.27 | 125% | 4.5 |
| | 1.27 | 1.19 | 130% | 4.5 |
| | 1.22 | 1.20 | 110% | 5.6 |
| | 1.21 | 1.18 | 115% | 4.0 |
| | 1.16 | 1.15 | 135% | 4.0 |

*1The image density of a copy image obtained by copying an original circular image which had a diameter of 5 mm and comprised a solid black pattern.
*2The image density of a copy image obtained by copying an A-3 original image which comprised of a solid black pattern.

TABLE 4-2

| | After 10,000 sheets of image formations | | | | |
|---|---|---|---|---|---|
| | Dmax (5 mm diameter) | Dmax (Solid black portion) | Thin-line reproducibility | Resolution (lines/mm) | Toner consumption (g/one sheet) |
| Example | | | | | |
| 1 | 1.33 | 1.33 | 105% | 6.3 | 0.023 |
| 2 | 1.32 | 1.32 | 103% | 6.3 | 0.021 |
| 3 | 1.30 | 1.28 | 108% | 5.6 | 0.022 |
| 4 | 1.35 | 1.34 | 102% | 6.3 | 0.022 |
| 5 | 1.36 | 1.36 | 101% | 7.1 | 0.023 |
| Comparative Example | | | | | |
| 1 | 1.28 | 1.22 | 145% | 4.0 | 0.045 |
| 2 | 1.25 | 1.10 | 150% | 3.6 | 0.039 |
| 3 | 1.18 | 1.05 | 135% | 4.0 | 0.032 |
| 4 | 1.20 | 1.15 | 130% | 4.0 | 0.031 |
| 5 | 1.13 | 1.03 | 150% | 3.6 | 0.036 |

EXAMPLE 6

| | |
|---|---|
| Styrene/butyl acrylate/divinyl benzene copolymer (copolymerization wt. ratio: 80/19.5/0.5, weight-average molecular weight: 320,000) | 100 wt. parts |
| Nigrosin (number-average particle size: about 3 microns) | 2 wt. parts |
| Low-molecular weight propylene-ethylene copolymer | 3 wt. parts |
| Carbon black | 4 wt. parts |

The above ingredients were well blended in a blender and melt-kneaded at 150° C. by means of a two-axis extruder. The kneaded product was cooled, coarsely crushed by a cutter mill, finely pulverized by means of a pulverizer using a jet air stream, and classified by a fixed-wall type wind-force classifier to obtain a classified powder product. Ultra-fine powder and coarse power were simultaneously and precisely removed from the classified powder by means of a multi-division classifier utilizing a Coanda effect (Elbow Jet Classifier available from Nittetsu Kogyo K.K.), thereby to obtain black fine powder (non-magnetic toner) having a number-average particle size of 7.6 microns.

The number-basis distribution and volume-basis distribution of the thus obtained non-magnetic toner of positively chargeable black fine powder were measured by means of a Coulter counter Model TA-II with a 100 micron-aperture in the above-described manner. The thus obtained results are shown in the following Table 5.

TABLE 5

| | | % by number (N) | | % by volume (V) | |
|---|---|---|---|---|---|
| Size (μm) | Number of particles | Distribution | Accumulation | Distribution | Accumulation |
| 2.00–2.52 | 3693 | 2.5 | 2.5 | 0.0 | 0.0 |
| 2.52–3.17 | 7394 | 4.9 | 7.4 | 0.4 | 0.4 |
| 3.17–4.00 | 14758 | 9.8 | 17.2 | 1.9 | 2.3 |
| 4.00–5.04 | 27788 | 18.5 | 35.7 | 7.4 | 9.7 |
| 5.04–6.35 | 35956 | 23.9 | 59.6 | 17.9 | 27.6 |
| 6.35–8.00 | 36389 | 24.2 | 83.8 | 33.3 | 60.9 |
| 8.00–10.08 | 20707 | 13.8 | 97.6 | 29.8 | 90.8 |
| 10.08–12.70 | 3418 | 2.3 | 99.9 | 8.6 | 99.4 |
| 12.70–16.00 | 139 | 0.1 | 100.0 | 0.6 | 100.0 |
| 16.00–20.20 | 7 | 0.0 | 100.0 | 0.0 | 100.0 |
| 20.20–25.40 | 5 | 0.0 | 100.0 | 0.0 | 100.0 |
| 25.40–32.00 | 3 | 0.0 | 100.0 | 0.0 | 100.0 |
| 32.00–40.30 | 0 | 0.0 | 100.0 | 0.0 | 100.0 |
| 40.30–50.80 | 0 | 0.0 | 100.0 | 0.0 | 100.0 |

FIG. 3 schematically shows the classification step using the multi-division classifier, and FIG. 4 shows a sectional perspective view of the multi-division classifier.

0.6 wt. parts of positively chargeable hydrophobic dry process silica (BET specific surface area: 200 $m^2/g$)

were added to 100 wt. parts of the black fine powder obtained above and mixed therewith by means of a Henschel mixer thereby to obtain a positively chargeable one-component developer comprising the non-magnetic toner (external addition product).

The above-mentioned non-magnetic toner showed a particle size distribution and various characteristics as shown in Table 6 appearing hereinafter.

The thus prepared one-component non-magnetic toner was charged in an image forming (developing) device as shown in FIG. 6, and a developing test was conducted.

The developing conditions used in this instance are explained with reference to FIG. 6. In FIG. 6, the one-component developer 105 contained in a developer chamber 103 is applied in a thin layer form onto the surface of a cylindrical sleeve 102 of stainless steel as a toner-carrying means rotating in the direction of an arrow 107 by the medium of a means 104 for forming the layer of the toner. The sleeve 102 is disposed near to a photosensitive drum 101, as an electrostatic image-holding means, comprising an organic photoconductor layer carrying a negative latent image. The minimum space between the sleeve 102 and the photosensitive drum 101 rotating in the direction of an arrow 109 is set to about 250 microns.

In the development, a bias of 2000 Hz/1300 Vpp obtained by superposing an AC bias and a DC bias was applied between the photosensitive drum 101 and the sleeve 102 by an alternating electric field-applying means 106. The layer of the one-component developer formed on the sleeve 102 had a thickness of about 25 microns, a charge amount per unit area of $7.0\times10^{-9}$ $\mu c/cm^2$, and a coating amount per unit area of 0.60 $mg/cm^2$.

By using the above-mentioned device, a negative latent image formed on the photosensitive drum 101 was developed by causing the one-component developer 105 having positive triboelectric charge to fly to the latent image (normal development). Thereafter, the resultant toner image was transferred to plain paper by using a negative corona transfer means and then fixed thereto by a hot pressure roller fixing means. Such image formation tests were successively conducted 10,000 times thereby to provide 10,000 sheets of toner images. The thus obtained results are shown in Table 7 appearing hereinafter.

As apparent from Table 7, both of the line portion and large image area portion of the letters showed a high image density. The non-magnetic toner of the present invention was excellent in thin-line reproducibility and resolution, and retained good image quality was obtained in the initial stage even after 10,000 sheets of image formations. Further, the copying cost per one sheet was low, whereby the magnetic toner of the present invention was excellent in economical characteristics.

EXAMPLE 7

A non-magnetic toner was prepared in the same manner as in Example 6 except that the micropulverization and classification conditions were controlled to obtain a toner having characteristics as shown in Table 6 appearing hereinafter. The thus obtained toner was evaluated in the same manner as in Example 6.

As a result, as shown in Table 7 appearing hereinafter, clear high-quality images were stably obtained.

EXAMPLE 8

0.6 wt. parts of positively chargeable hydrophobic silica and 0.5 wt. parts of tin oxide fine powder (particle size: about 0.4 micron) were added to 100 wt. parts of the black fine powder (non-magnetic toner) showing a particle size distribution as shown in Table 6, and mixed therewith by means of a Henschel mixer thereby to obtain a one-component non-magnetic developer.

The thus obtained developer was evaluated in the same manner as in Example 6. As a result, as shown in Table 7 appearing hereinafter, clear high-quality images were stably obtained.

EXAMPLE 9

0.6 wt. parts of positively chargeable hydrophobic dry process silica and 0.2 wt. part of polyvinylidene fluoride fine powder (average primary particle size: about 0.3 microns, weight-average molecular weight (Mw): 300,000) were added to 100 wt. parts of the black fine powder (non-magnetic toner) obtained in Example 6, and mixed therewith by means of a Henschel mixer thereby to obtain a one-component developer.

The thus obtained developer was evaluated in the same manner as in Example 1. As a result, as shown in Table 7 appearing hereinafter, there were obtained better images excellent in image density and image quality.

EXAMPLE 10

| | |
|---|---|
| Crosslinked polyester resin (Mw = 50,000, glass transition point (Tg) = 60° C.) | 100 wt. parts |
| 3,5-di-t-butylsalicylic acid metal salt | 1 wt. part |
| Low-molecular weight propylene-ethylene copolymer | 3 wt. parts |
| Carbon black | 3 wt. parts |

By using the above materials, black fine powder was prepared in the same manner as in Example 6.

0.3 wt. parts of negatively chargeable hydrophobic silica (BET specific surface area: 130 $m^2/g$) and 0.5 wt. parts of spherical paraticles (average particle size: about 0.3 micron) comprising an n-butylacrylate-methylmethacrylate copolymer were added to 100 wt. parts of the black fine powder (non-magnetic toner) obtained above and mixed therewith by means of a Henschel mixer thereby to obtain a negatively chargeable one-component non-magnetic developer.

The above-mentioned black fine powder (non-magnetic toner) showed a particle size distribution, etc., as shown in Table 6 appearing hereinafter.

The thus prepared one-component developer was charged in a copying machine (NP-7550, mfd. by Canon K.K.) having an amorphous silicon photosensitive drum capable of forming a positive electrostatic latent image and image formation tests of 10,000 sheets were conducted.

As a result, as shown in Table 7 appearing hereinafter, clear high-quality images were stably obtained.

EXAMPLE 11

The positively chargeable one-component developer prepared in Example 6 was charged in a digital-type copying machine (NP-9330, mfd. by Canon K.K.) having an amorphous silicon photosensitive drum and image formation tests of 10,000 sheets were conducted by developing a positive electrostatic latent image by a reversal development system.

As a result, as shown in Table 7 appearing hereinafter, the thin-line reproducibility and resolution were excellent and there were obtained clear images having a high gradational characteristic.

COMPARATIVE EXAMPLE 6

Black fine powder (non-magnetic toner) as shown in Table 6 was prepared in the same manner as in Example 6, except that two fixed-wall type wind-force classifiers used in Example 6 were used for the classification instead of the combination of the fixed-wall type wind-force classifier and the multi-division classifier used in Example 6.

In the thus prepared non-magnetic toner of Comparative Example 6, the percentage by number of the magnetic toner particles of 5 microns or smaller was smaller than the range thereof defined in the present invention, the volume-average particle size was larger than the range thereof defined in the present invention, and the value of (% by number (N))/(% by volume (V)) was larger than the range thereof defined in the present invention, whereby the conditions required in the present invention were not satisfied. The particle size distribution of the non-magnetic toner obtained above is shown in the following Table 6.

0.5 wt. parts of positively chargeable hydrophobic dry process silica were added to 100 wt. parts of the black fine powder obtained above mixed therewith in the same manner as in Example 6 thereby to obtain a one-component non-magnetic developer. The thus obtained developer was subjected to image formation tests under the same conditions as in Example 6.

The layer of the one-component developer formed on the sleeve 102 had a thickness of about 65 microns, charge amount per unit area of $9.0\times10^{-9}$ $\mu c/cm^2$, and a coating amount per unit area of 1.1 $mg/cm^2$.

In the resultant images, the toner particles remarkably protruded from the latent image formed on the photosensitive member, the thin-line reproducibility was 145% which was poorer than that in Example 6, and the resolution was 3.6 lines/mm. Further, after 10,000 sheets of image formations, the image density in the solid black pattern decreased and the thin line reproducibility and resolution deteriorated. It was observed that the toner adhered to the application member 104 and the sleeve 102 along with successive copying. Moreover, the toner consumption was large.

The results are shown in Table 7 appearing hereinafter.

COMPARATIVE EXAMPLE 7

Evaluation was conducted in the same manner as in Example 1 except that a toner as shown in Table 7 was used instead of the non-magnetic toner used in Example 6.

In the resultant images, thin lines were contaminated in several places presumably due to the aggregates of toner particles, and the resolution was 3.6 lines/mm. The solid black pattern, particularly the inner portion thereof, had a lower image density than that in the line image and the edge portion of the image. Further, fog contamination in spot forms occurred, and the image quality was further deteriorated in successive copying.

COMPARATIVE EXAMPLE 8

Evaluation was conducted in the same manner as in Example 6 except that a toner as shown in Table 6 was used instead of the non-magnetic toner used in Example 6.

The developed image formed on the drum had relatively good image quality, although it was somewhat disturbed. However, the toner image was remarkably disturbed in the transfer step, whereby transfer failure occurred and the image density decreased. Particularly, in successive copying, the image density was further decreased and the image quality was further deteriorated because poor toner particles remained and accumulated in the developing device.

COMPARATIVE EXAMPLE 9

Evaluation was conducted in the same manner as in Example 6 except that a toner as shown in Table 6 was used instead of the non-magnetic toner used in Example 6.

In the resultant images, the image density was low and the contour was unclear and the sharpness was lacking, because the cover-up of toner particles to the edge portions of images was poor. Further, the resolution and gradational characteristic were also poor. When successive copying was conducted, the sharpness, thin-line reproducibility and resolution were further deteriorated.

COMPARATIVE EXAMPLE 10

Evaluation was conducted in the same manner as in Example 6 except that a toner as shown in Table 6 was used instead of the non-magnetic toner used in Example 6.

In the resultant images, the image density, resolution and the thin line reproducibility were all poor. Further, the edge portion of the image lacked sharpness, and the thin lines were interrupted and unclear.

The results in Examples 6–11 and Comparative Examples 6–10 described above are inclusively shown in the following Tables 6 and 7.

TABLE 6

| | Particle size distribution of toner | | | | |
|---|---|---|---|---|---|
| | % by number of particles ≦5 μm | % by volume of particles ≧16 μm | % by number of particles of 8–12.7 μm | Volume-average particle size (μm) | (% by number)/(% by volume) of particles ≦5 μm |
| Example | | | | | |
| 6 | 36 | 0.6 | 16 | 7.6 | 3.7 |
| 7 | 21 | 0.4 | 22 | 8.8 | 4.8 |
| 8 | 54 | 0.1 | 12 | 6.5 | 2.8 |
| 9 | 36 | 0.6 | 16 | 7.6 | 3.7 |
| 10 | 43 | 0.5 | 10 | 7.4 | 4.5 |
| 11 | 36 | 0.6 | 16 | 7.6 | 3.7 |
| Comparative Example | | | | | |

TABLE 6-continued

| | Particle size distribution of toner | | | | |
|---|---|---|---|---|---|
| | % by number of particles ≦5 μm | % by volume of particles ≧16 μm | % by number of particles of 8–12.7 μm | Volume-average particle size (μm) | (% by number)/(% by volume) of particles ≦5 μm |
| 6 | 9.0 | 4.1 | 50 | 12.3 | 13.5 |
| 7 | 68 | 0.1 | 5 | 6.0 | 1.5 |
| 8 | 27 | 4 | 15 | 7.6 | 6.4 |
| 9 | 41 | 0.3 | 7 | 6.7 | 2.1 |
| 10 | 14 | 0.2 | 51 | 9.9 | 2.9 |

TABLE 7-1

| | Initial stage | | | |
|---|---|---|---|---|
| | Dmax (5 mm diameter) | Dmax (solid black portion) | Thin-line reproducibility | Resolution (lines/mm) |
| Example | | | | |
| 6 | 1.33 | 1.32 | 105% | 6.3 |
| 7 | 1.32 | 1.30 | 105% | 6.3 |
| 8 | 1.28 | 1.27 | 107% | 6.3 |
| 9 | 1.35 | 1.33 | 102% | 6.3 |
| 10 | 1.33 | 1.32 | 102% | 6.3 |
| 11 | 1.35 | 1.32 | 102% | 7.1 |
| Comparative Example | | | | |
| 6 | 1.25 | 1.20 | 145% | 3.6 |
| 7 | 1.25 | 1.15 | 150% | 3.6 |
| 8 | 1.20 | 1.18 | 120% | 4.0 |
| 9 | 1.15 | 1.12 | 130% | 3.2 |
| 10 | 1.12 | 0.98 | 140% | 3.2 |

TABLE 7-2

| | After 10,000 sheets of image formations | | | | |
|---|---|---|---|---|---|
| | Dmax (5 mm diameter) | Dmax (Solid black portion) | Thin-line reproducibility | Resolution (lines/mm) | Toner consumption (g/one sheet) |
| Example | | | | | |
| 6 | 1.33 | 1.33 | 105% | 6.3 | 0.023 |
| 7 | 1.32 | 1.31 | 105% | 6.3 | 0.022 |
| 8 | 1.31 | 1.30 | 105% | 6.3 | 0.021 |
| 9 | 1.38 | 1.38 | 102% | 7.1 | 0.023 |
| 10 | 1.35 | 1.33 | 102% | 6.3 | 0.020 |
| 11 | 1.35 | 1.32 | 102% | 7.1 | 0.022 |
| Comparative Example | | | | | |
| 6 | 1.20 | 1.15 | 160% | 3.2 | 0.050 |
| 7 | 1.23 | 1.10 | 160% | 3.2 | 0.040 |
| 8 | 1.20 | 1.08 | 140% | 3.6 | 0.036 |
| 9 | 1.18 | 1.05 | 150% | 3.2 | 0.030 |
| 10 | 1.10 | 0.95 | 160% | 3.2 | 0.035 |

EXAMPLE 13

| | |
|---|---|
| Polyester resin (polycondensation product of propoxidized bisphenol and fumaric acid) | 100 wt. parts |
| Colorant (C.I. Pigment Yellow 17) | 3.5 wt. parts |
| Negative charge controller (dialkylsalicylic acid chromium complex) | 4 wt. parts |

The above component were preliminarily mixed by means of a Henschel mixer sufficiently, and melt-kneaded by means of a three-roller mill at least two times. The kneaded product was cooled, coarsely crushed by a cutter mill, finely pulverized by means of a pulverizer using a jet air stream, and classified by a fixed-wall type wind-force classifier to obtain a classified powder product. Ultra-fine powder and coarse power were simultaneously and precisely removed from the classified powder by means of a multi-division classifier utilizing a Coanda effect (Elbow Jet Classifier available from Nittetsu Kogyo K.K.), thereby to obtain yellow fine powder (non-magnetic toner) having a number-average particle size of 7.9 microns.

0.5 wt. parts of hydrophobic silica treated with hexamethyldisilosane were externally mixed with 100 wt. parts of the yellow fine powder to obtain a yellow toner as an external addition product (non-magnetic color toner).

The thus obtained non-magnetic toner has a particle size distribution as shown in Table 8 appearing hereinafter.

The non-magnetic color toner composition (external addition product) in an amount of 9 wt. parts was mixed with a Cu-Zn-Fe-basis ferrite carrier (average particle size: 48 microns, weight of 250 mesh-pass and 350 mesh-on: 79 wt. %, true density: 4.5 g/m$^3$) coated with about 0.5 wt. % of a 50:50 (wt.)-mixture of vinylidene fluoride-tetrafluoroethylene copolymer (copolymerization weight ratio =8:2) and styrene-2-ethylhexyl acrylate-methyl methacrylate copolymer (copolymerization weight ratio =45:20:35) so as to provide a total amount of 100 wt. parts, whereby a two-component developer was prepared.

The two-component developer was charged in a color laser-type electrophotographic apparatus (PIXEL, mfd. by Canon K.K.) and subjected to an image formation test of 2,000 sheets by using reversal development system in a mono-color mode. The results are shown in Table 9 appearing hereinafter.

As apparent from Table 9, both of the line portion and large image area portion of the letters showed a high image density. The non-magnetic toner of the present invention was excellent in thin-line reproducibility and resolution, and retained good image quality obtained in the initial stage even after 2,000 sheets of image formations. Further, the copying cost per one sheet was low, whereby the non-magnetic toner of the present invention was excellent in economical characteristics.

Particularly, there was substantially no difference between the cover-up of the inner portion and that of the edge portion with respect to a solid image, and the cover-up of the inner portion of the solid image was uniform, whereby an image excellent in gloss characteristic was obtained.

The gloss used herein was measured in the following manner.

A gloss meter Model VG-10 (available from Nihon Denshoku K.K.) was used. A solid color image was used as a sample image. For measurement, a voltage of 6 volts was supplied to the gloss meter from a constant-voltage power supply, and the light-projecting angle and the light-receiving angle are respectively set to 60 degrees.

Zero point adjustment and standard adjustment were conducted by using a standard plate. Then, measurement was conducted by placing a sample image on the sample table, and further by superposing thereon three sheets of white paper. The values indicated on the display were read in % units. At this time, the S–S/10 changeover switch is set to the S side and the angle-sensitivity changeover switch is set to 45–60.

EXAMPLE 14

A non-magnetic toner (non-magnetic color toner) having a particle size distribution as shown in Table 8 was prepared in the same manner as in Example 13 except that 1.0 wt. parts of C.I. Solvent Red 52 (magenta colorant) and 0.9 wt. parts of C.I. Solvent Red 49 were used instead of the 3.5 wt. parts of C.I. Pigment Yellow 17 (yellow colorant).

By using the thus obtained magenta toner in the same manner as in Example 13, an evaluation was conducted in the same manner as in Example 13.

As a result, high-quality magenta images excellent in clearness and gloss were stably obtained, as shown in Table 9.

EXAMPLE 15

A cyan toner (non-magnetic color toner) having a particle size distribution as shown in Table 8 was prepared in the same manner as in Example 13 except that 5.0 wt. parts of C.I. Solvent Blue 15 (cyan colorant) were used instead of the 3.5 wt. parts of C.I. Pigment Yellow 17 (yellow colorant).

By using the thus obtained cyan toner in the same manner as in Example 13, an evaluation was conducted in the same manner as in Example 13.

As a result, high-quality cyan images excellent in clearness and gloss were stably obtained, as shown in Table 9.

EXAMPLE 16

A black toner (non-magnetic color toner) having a particle size distribution as shown in Table 8 was prepared in the same manner as in Example 13 except that a mixture (black colorant) of 1.2 wt. parts of C.I. Pigment Yellow 17, 2.8 wt. parts of C.I. Pigment Red 5 and 1.5 wt. parts of C.I. Pigment Blue 15 was used instead of the yellow colorant used in Example 13.

By using the thus obtained black toner in the same manner as in Example 13, an evaluation was conducted in the same manner as in Example 13.

As a result, high-quality black images excellent in clearness and gloss were stably obtained, as shown in Table 9.

COMPARATIVE EXAMPLE 11

A yellow toner having a particle size distribution as shown in Table 8 was prepared in the same manner as in Example 13, except that two fixed-wall type wind-force classifiers used in Example 13 were used for the classification instead of the combination of the fixed-wall type wind-force classifier and the multi-division classifier used in Example 13.

In the thus prepared yellow non-magnetic toner of Comparative Example 11, the percentage by number of the non-magnetic toner particles of 5 microns or smaller was smaller than the range thereof defined in the present invention, the volume-average particle size was larger than the range thereof defined in the present invention, and the value of (% by number (N))/(% by volume (V)) of the non-magnetic toner particles of 5 microns or smaller was larger than the range thereof defined in the present invention, whereby the conditions required in the present invention were not satisfied.

By using the thus obtained yellow toner, a two-component developer was prepared in the same manner as in Example 13 and was subjected to an image formation evaluation under similar conditions as in Example 13.

In the resultant images, the toner particles remarkably protruded from the latent image formed on the photosensitive member as compared with that in Example 13, the sharpness was lacking and the resolution was 4.0 lines/mm which was somewhat inferior to that obtained in Example 13. Further, toner consumption was large.

Further, in comparison with Example 13, the cover-up in the inner portion was insufficient when compared with that in the edge portion with respect to a solid image. Moreover, the cover-up of toner particles was ununiform in some portions of the inner portion of the solid image, and the resultant image was somewhat inferior in gloss.

COMPARATIVE EXAMPLE 12

A magenta toner having a particle size distribution as shown in Table 8 was prepared in the same manner as in Example 13, except that two fixed-wall type wind-force classifiers used in Example 14 were used for the classification instead of the combination of the fixed-wall type wind-force classifier and the multi-division classifier used in Example 14.

By using the thus obtained magenta toner in the same manner as in Example 13, an evaluation was conducted in the same manner as in Example 13.

As a result, as shown in Table 9, there were obtained magenta images which were inferior to those obtained in Example 14 because the line resolution and gloss were somewhat poor and the image density in the solid image portion was low.

COMPARATIVE EXAMPLE 13

A cyan toner having a particle size distribution as shown in Table 8 was prepared in the same manner as in Example 15, except that two fixed-wall type wind-force classifiers used in Example 15 were used for the classification instead of the combination of the fixed-wall type wind-force classifier and the multi-division classifier used in Example 15.

By using the thus obtained magenta toner in the same manner as in Example 13, an evaluation was conducted in the same manner as in Example 13.

As a result, as shown in Table 9, there were obtained cyan images which were inferior to those obtained in Example 15 because the line resolution and gloss were somewhat poor and the image density in the solid image portion was low.

COMPARATIVE EXAMPLE 14

A black toner having a particle size distribution as shown in Table 8 was prepared in the same manner as in Example 16, except that two fixed-wall type wind-force classifiers used in Example 16 were used for the classification instead of the combination of the fixed-wall type wind-force classifier and the multi-division classifier used in Example 16.

By using the thus obtained magenta toner in the same manner as in Example 13, an evaluation was conducted in the same manner as in Example 13.

As a result, as shown in Table 9, there were obtained black images which were inferior to those obtained in Example 16 because the line resolution and gloss were somewhat poor and the image density in the solid image portion was low.

EXAMPLE 17

By using the respective two-component developers obtained in Examples 13–16, multi-color and full-color copy images were obtained in the same manner as in Example 13 except that a full-color mode was used instead of the monocolor mode. The thus obtained color images were evaluated in the same manner as in Example 13.

As a result, as shown in Table 9, there were stably obtained clear full-color copy images which faithfully reproduced the original full-color chart. Particularly, because cover-up of the toner particles was uniform in the inner portion of a solid image, no& only the gloss but also the color mixing characteristic was enhanced, whereby full-color images excellent in color reproducibility were obtained.

COMPARATIVE EXAMPLE 15

By using the respective two-component developer obtained in Comparative Examples 11–14, multi-color and full-color copy images were obtained in the same manner as in Example 17 except that a full-color mode was used instead of the monocolor mode. The thus obtained color images were evaluated in the same manner as in Example 17.

As a result, there were stably obtained clear full-color copy images which substantially faithfully reproduced the original full-color chart. However, it was observed that cover-up of the toner particles was ununiform in some portions of the inner portion of a solid image. Further, these images were poor in gloss and color reproducibility.

TABLE 8

| | Particle size distribution of toner | | | | |
|---|---|---|---|---|---|
| | % by number of particles ≦5 μm | % by volume of particles ≧16 μm | % by number of particles of 8–12.7 μm | Volume-average particle size (μm) | (% by number)/(% by volume) of particles ≦5 μm |
| Example | | | | | |
| 13 | 34 | 0 | 16 | 7.9 | 3.4 |
| 14 | 34 | 0 | 17 | 7.9 | 3.4 |
| 15 | 35 | 0 | 17 | 7.9 | 3.4 |
| 16 | 34 | 0 | 17 | 7.9 | 3.5 |
| Comparative Example | | | | | |
| 11 | 13 | 2.3 | 46 | 12.2 | 34 |
| 12 | 12 | 2.3 | 48 | 12.3 | 39 |
| 13 | 13 | 2.3 | 46 | 12.3 | 42 |
| 14 | 13 | 2.3 | 46 | 12.2 | 34 |

TABLE 9-1

| | Initial stage | | | |
|---|---|---|---|---|
| | Dmax (5 mm diameter) | Dmax (solid image portion) | Gloss | Resolution (lines/mm) |
| Example | | | | |
| 13 | 1.50 | 1.50 | 19.6% | 5.0 |
| 14 | 1.49 | 1.51 | 24.4% | 5.0 |
| 15 | 1.47 | 1.49 | 21.9% | 5.0 |
| 16 | 1.52 | 1.52 | 20.3% | 5.0 |
| 17 | 1.52 | 1.53 | 22.1% | 4.5 |
| Comparative Example | | | | |
| 11 | 1.52 | 1.42 | 7.4% | 4.0 |
| 12 | 1.49 | 1.42 | 16.0% | 4.0 |
| 13 | 1.50 | 1.42 | 10.7% | 4.0 |
| 14 | 1.53 | 1.41 | 12.2% | 4.0 |
| 15 | 1.50 | 1.41 | 15.5% | 3.6 |

TABLE 9-2

| | After 2,000 sheets of image formations | | | | |
|---|---|---|---|---|---|
| | Dmax (5 mm dia.) | Dmax (Solid image portion) | Gloss | Resolution (lines/mm) | Toner consumption (g/one sheet) |
| Example | | | | | |
| 13 | 1.53 | 1.53 | 20.7% | 5.0 | 0.023 |
| 14 | 1.52 | 1.52 | 25.5% | 5.0 | 0.022 |
| 15 | 1.48 | 1.50 | 23.0% | 5.0 | 0.022 |
| 16 | 1.54 | 1.55 | 21.4% | 5.0 | 0.021 |
| 17 | 1.49 | 1.49 | 23.2% | 4.5 | 0.024 |
| Comparative Example | | | | | |
| 11 | 1.52 | 1.41 | 7.9% | 4.0 | 0.046 |
| 12 | 1.50 | 1.40 | 15.9% | 4.0 | 0.049 |
| 13 | 1.47 | 1.40 | 10.9% | 4.0 | 0.042 |

TABLE 9-2-continued

| | After 2,000 sheets of image formations | | | | |
|---|---|---|---|---|---|
| | Dmax (5 mm dia.) | Dmax (Solid image portion) | Gloss | Resolution (lines/mm) | Toner consumption (g/one sheet) |
| 14 | 1.47 | 1.39 | 12.5% | 4.0 | 0.043 |
| 15 | 1.53 | 1.40 | 15.6% | 3.6 | 0.046 |

What is claimed is:

1. A developer for developing electrostatic images, comprising a non-magnetic toner, said toner containing 17–60% by number of non-magnetic toner particles having a particle size of 5 microns or smaller, containing 1–30% by number of non-magnetic toner particles having a particle size of 8–12.7 microns, and containing 2.0% by volume or less of non-magnetic toner particles having a particle size of 16 microns or larger;

wherein the non-magnetic toner has a volume-average particle size of 4–10 microns, and the non-magnetic toner particles having a particle size of 5 microns or smaller have a particle size distribution satisfying the following formula:

$$N/V=-0.04N+k,$$

wherein N denotes the percentage by number of non-magnetic toner particles having a particle size of 5 micron or smaller, V denotes the percentage by volume of non-magnetic toner particles having a particle size of 5 microns or smaller, k denotes a positive number of 4.5–6.5, and N denotes a positive number of 17–60.

2. A developer according to claim 1, wherein the non-magnetic toner contains 1–23% by number of non-magnetic toner particles having a particle size of 8–12.7 microns.

3. A developer according to claim 1, wherein the non-magnetic toner contains 25–50% by number of non-magnetic toner particles having a particle size of 5 microns or smaller.

4. A developer according to claim 1, wherein the non-magnetic toner contains 30–50% by number of non-magnetic toner particles having a particle size of 5 microns or smaller.

5. A developer according to claim 1, wherein the non-magnetic toner contains 8–20% by number of non-magnetic toner particles having a particle size of 8–12.7 microns.

6. A developer according to claim 1, wherein the non-magnetic toner particles having a particle size of 5 microns or smaller satisfy the following formula:

$$N/V=-0.04N+k,$$

wherein k denotes a number of 4.5–6.0, and N denotes a number of 25–50.

7. A developer according to claim 1, wherein the non-magnetic toner particles having a particle size of 5 microns or smaller satisfy the following formula:

$$N/V=-0.04N+k,$$

wherein k denotes a number of 4.5–5.5, and N denotes a number of 30–50.

8. A developer according to claim 1, wherein the non-magnetic toner has a volume-average particle size of 4–8 microns.

9. A developer according to claim 1, wherein the non-magnetic toner has been mixed with silica fine powder.

10. A developer according to claim 9, wherein 0.01–8 wt. parts of the silica fine powder has been mixed with 100 wt. parts of the non-magnetic toner.

11. A developer according to claim 9, wherein 0.1–5 wt. parts of the silica fine powder has been mixed with 100 wt. parts of the non-magnetic toner.

12. A developer according to claim 9, wherein the non-magnetic toner has positive chargeability and the silica fine powder has positive chargeability.

13. A developer according to claim 9, wherein the non-magnetic toner has negative chargeability and the silica fine powder has negative chargeability.

14. A developer according to claim 1, wherein the non-magnetic toner has been mixed with fine powder of a fluorine-containing polymer.

15. A developer according to claim 14, wherein the powder of the fluorine-containing polymer is contained in an amount of 0.01–2.0 wt. % based on the weight of the non-magnetic toner.

16. A developer according to claim 14, wherein the fine powder of the fluorine-containing polymer is contained in an amount of 0.02–1.0 wt. % based on the weight of the non-magnetic toner.

17. A developer according to claim 1, wherein the non-magnetic toner has been mixed with silica fine powder and fine powder of a fluorine-containing polymer.

18. A developer according to claim 17, wherein 0.01–8 wt. parts of the silica fine powder and 0.01–2.0 wt. % of the fine powder of a fluorine-containing polymer have been mixed with 100 wt. parts of the non-magnetic toner.

19. A developer according to claim 1, wherein the non-magnetic toner has been mixed with a carrier.

20. A developer according to claim 19, wherein 10 wt. parts of the non-magnetic toner has been mixed with 10–1000 wt. parts of the carrier.

21. A developer according to claim 19, wherein 10 wt. parts of the non-magnetic toner has been mixed with 30–500 wt. parts of the carrier.

22. A developer according to claim 20, wherein the carrier has a volume-average particle size of 4–100 microns.

23. A developer according to claim 20, wherein the carrier has a volume-average particle size of 10–50 microns.

24. A developer according to claim 20, wherein the carrier has a volume-average particle size of 30–50 microns.

25. A developer according to claim 19, wherein the carrier comprises magnetic particles.

26. A developer according to claim 25, wherein the carrier comprises magnetic particles coated with a resin.

27. A developer according to claim 1, wherein the non-magnetic toner has a volume-average particle size of 4–9 microns, and wherein the non-magnetic toner particles having a particle size of 5 microns or smaller satisfy the following formula:

$$N/V = -0.04N + K,$$

where K denotes a number between 4.5–6.0, and N denotes a number between 25–50.

28. A developer according to claim 27, wherein the non-magnetic toner contains 0.5% by volume or less of non-magnetic toner particles having a particle size of 16 microns or larger.

29. A developer according to claim 28, wherein the non-magnetic toner contains a styrene copolymer as a binder resin.

30. A developer according to claim 28, wherein the non-magnetic toner contains a polyester resin as a binder resin.

31. A developer according to claim 1, wherein the non-magnetic toner has a volume-average particle size of 4–8 microns, and wherein the non-magnetic toner particles having a particle size of 5 microns or smaller satisfy the following formula:

$$N/V = -0.04N + K,$$

where K denotes a number between 4.5–6.00, and N denotes a number between 25–50.

32. A developer according to claim 31, wherein the non-magnetic toner contains 0.5% by volume or less of non-magnetic toner particles having a particle size of 16 microns or larger.

33. A developer according to claim 32, wherein the non-magnetic toner contains a styrene copolymer as a binder resin.

34. A developer according to claim 32, wherein the non-magnetic toner contains a polyester resin as a binder resin.

35. A developer according to claim 25, wherein the non-magnetic toner comprises a polyester resin, a colorant and a dialkylsalicylic acid chromium complex.

* * * * *

UNITED STATES PATENT AND TRADEMARK OFFICE

CERTIFICATE OF CORRECTION

PATENT NO. : 4,985,327

DATED : January 15, 1991

INVENTOR(S) : KIICHIRO SAKASHITA, ET AL.

It is certified that error appears in the above-identified patent and that said Letters Patent is hereby corrected as shown below:

BEFORE [30] FOREIGN APPLICATION PRIORITY DATA

Insert: --[63] Related U.S. Application Data
Continuation of application
Ser. No. 313,518 filed Feb. 22, 1989--.

IN [56] REFERENCES CITED

U.S. PATENT DOCUMENTS, "3,674,736 7/1922 Lerman et al."
should read --3,674,736 7/1972 Lerman et al.--.

IN [57] ABSTRACT

Line 2 from bottom, "smaller k" should read --smaller, k--.

COLUMN 1

Line 62, "Pat. Nos. 3942979, 3969251 and 4112024)" should read --Pat. Nos. 3,942,979, 3,969,251 and 4,112,024)--.

COLUMN 2

Line 18, "U.S. Pat. No. 4284701)" should read --U.S. Pat. No. 4,284,701)--.

COLUMN 3

Line 59, "cron" should read --crons--.

UNITED STATES PATENT AND TRADEMARK OFFICE

CERTIFICATE OF CORRECTION

PATENT NO. : 4,985,327

DATED : January 15, 1991

INVENTOR(S) : KIICHIRO SAKASHITA, ET AL.

It is certified that error appears in the above-identified patent and that said Letters Patent is hereby corrected as shown below:

COLUMN 6

Line 44, "hand if," should read --hand, if--.
Line 63, "hand if," should read --hand, if--.

COLUMN 7

Line 15, "thinline" should read --thin-line--.

COLUMN 8

Line 53, "are" should be deleted.

COLUMN 10

Line 12, "clude;" should read --clude:--.

COLUMN 11

Line 47, "provides" should read --provide--.
Line 64, "groups" should read --group--.

COLUMN 14

Line 67, "toner a," should read --toner, a--.

COLUMN 15

Line 23, "particle" should read --particles--.

UNITED STATES PATENT AND TRADEMARK OFFICE
CERTIFICATE OF CORRECTION

PATENT NO. : 4,985,327

DATED : January 15, 1991

INVENTOR(S) : KIICHIRO SAKASHITA, ET AL.

It is certified that error appears in the above-identified patent and that said Letters Patent is hereby corrected as shown below:

COLUMN 16

Line 27, "are" should read --area--.
Line 55, "magnetic particle 27" should read --magnetic particles 27--.

COLUMN 18

Line 16, "a to" should read --to a--.
Line 38, "hand if," should read --hand, if--.
Line 44, "Incidentaally," should read --Incidentally,--.

COLUMN 20

Line 64, "drum 3 an" should read --drum 3, an--.

COLUMN 25

TABLE 4-1, "Comparative Example 1.28 1.27 1.22 1.21 1.16" should read

--Comparative Example

| | |
|---|---|
| 1 | 1.28 |
| 2 | 1.27 |
| 3 | 1.22 |
| 4 | 1.21 |
| 5 | 1.16--. |

UNITED STATES PATENT AND TRADEMARK OFFICE

CERTIFICATE OF CORRECTION

PATENT NO. : 4,985,327

DATED : January 15, 1991

INVENTOR(S) : KIICHIRO SAKASHITA, ET AL.

It is certified that error appears in the above-identified patent and that said Letters Patent is hereby corrected as shown below:

COLUMN 28

Line 43, "paraticles" should read --particles--.

COLUMN 31

Line 58, "component" should read --components--.

COLUMN 32

Line 15, "amethyldisilosane" should read --amethyldisiloxane--.

COLUMN 36

Line 1, "no&" should read --not--.
Line 7, "developer" should read --developers--.

COLUMN 37

Line 30, "cron" should read --crons--.

COLUMN 39

Line 4, "N/V=-0.04N+K." should read --N/V=-0.04N+k.--.
Line 6, "K" should read --k--.

UNITED STATES PATENT AND TRADEMARK OFFICE

CERTIFICATE OF CORRECTION

PATENT NO. : 4,985,327

DATED : January 15, 1991

INVENTOR(S) : KIICHIRO SAKASHITA, ET AL.

It is certified that error appears in the above-identified patent and that said Letters Patent is hereby corrected as shown below:

COLUMN 40

Line 4, "N/V- -0.04N+K." should read --N/V=-0.04N+k.--.
Line 6, "K" should read --k-- and 4.5-6.00" should read --4.5-6.0--.

Signed and Sealed this

Eighth Day of September, 1992

*Attest:*

*Attesting Officer*

DOUGLAS B. COMER

*Acting Commissioner of Patents and Trademarks*